US008430085B2

(12) United States Patent
Tippmann, Sr. et al.

(10) Patent No.: US 8,430,085 B2
(45) Date of Patent: Apr. 30, 2013

(54) AIR POWERED BELT-FED GUN

(75) Inventors: Dennis J. Tippmann, Sr., New Haven, IN (US); Kevin P. Mott, Fort Wayne, IN (US)

(73) Assignee: Tippmann Industrial Products, Inc, Fort Wayne, IN (US)

( * ) Notice: Subject to any disclaimer, the term of this patent is extended or adjusted under 35 U.S.C. 154(b) by 360 days.

(21) Appl. No.: 13/008,145

(22) Filed: Jan. 18, 2011

(65) Prior Publication Data

US 2011/0186026 A1 Aug. 4, 2011

Related U.S. Application Data

(60) Provisional application No. 61/391,268, filed on Oct. 8, 2010, provisional application No. 61/296,150, filed on Jan. 19, 2010.

(51) Int. Cl.
*F41B 11/02* (2006.01)

(52) U.S. Cl.
USPC ..... 124/73; 124/48

(58) Field of Classification Search ..... 124/48, 124/45, 72, 73, 74, 76
See application file for complete search history.

(56) References Cited

U.S. PATENT DOCUMENTS

| | | | |
|---|---|---|---|
| 399,882 | A | 3/1889 | Graydon |
| 2,238,384 | A | 4/1941 | Feltman |
| 2,312,244 | A | 2/1943 | Feltman |
| 2,801,624 | A | 8/1957 | Feltman |
| 2,837,076 | A | 6/1958 | Koci et al. |
| 3,695,246 | A | 10/1972 | Filippi et al. |
| 4,819,609 | A | 4/1989 | Tippmann |
| 4,834,058 | A | 5/1989 | Gegere |
| 5,383,442 | A | 1/1995 | Tippmann |
| 5,592,931 | A | 1/1997 | Johnson et al. |
| 5,596,978 | A | 1/1997 | Johnson et al. |
| 5,660,159 | A | 8/1997 | Clayton |
| 5,722,383 | A | 3/1998 | Tippmann, Sr. et al. |
| 5,724,955 | A | 3/1998 | Johnson et al. |
| 5,878,734 | A | 3/1999 | Johnson et al. |
| 6,003,503 | A | 12/1999 | Johnson et al. |
| 6,152,125 | A | 11/2000 | Piper |
| 6,364,162 | B1 | 4/2002 | Johnson et al. |
| 6,439,216 | B1 | 8/2002 | Johnson et al. |
| 6,739,323 | B2 | 5/2004 | Tippmann, Jr. |
| 6,772,746 | B2 | 8/2004 | Gabrel |
| 7,882,830 | B1 | 2/2011 | Gabrel |
| 2008/0078369 | A1 | 4/2008 | Yeung |

*Primary Examiner* — Michael Carone
*Assistant Examiner* — Reginald Tillman, Jr.
(74) *Attorney, Agent, or Firm* — Barnes & Thornburg LLP

(57) ABSTRACT

A less-than-lethal pellet gun is provided. The gun includes a plurality of links each holding a pellet. A feed cylinder is configured to advance the links to a firing position and eject each link after its pellet has been fired. The feed cylinder includes a slot portion and a gear portion. The slot portion includes a first slot region, a second slot region, a first angled slot region, and a second angled slot region. A linkage arm is configured to engage the slot portion of the feed cylinder such that linear movement of the linkage arm rotates the feed cylinder to move the pellet to a firing position.

22 Claims, 34 Drawing Sheets

AIR POWERED BELT-FED GUN

RELATED APPLICATIONS

The present application is related to and claims priority to U.S. Provisional Patent Application, Ser. No. 61/391,268, filed on Oct. 8, 2010, entitled "Air Powered Belt-Fed Gun-2" and to U.S. Provisional Patent Application Ser. No. 61/296,150, filed Jan. 19, 2010, entitled "Air Powered Belt-Fed Gun." The subject matter disclosed in those provisional applications is hereby expressly incorporated into the present application.

TECHNICAL FIELD AND SUMMARY

The present disclosure is related to pellet guns and particularly air powered automatic belt-fed pellet guns.

An illustrative embodiment of the present disclosure is directed to a less-than-lethal air powered pellet gun configured to automatically feed pellets from a belt to a firing chamber to be shot through the gun's bore. The pellets are each located inside a link which forms the belt and are fed into the firing chamber in rapid succession. The gun, likewise, fires each pellet in rapid succession. So long as air is supplied to the firing mechanism, by continuing to depress the trigger, the gun will continually shoot pellets one after another. The net effect is a machine gun-like rapid firing belt-fed air powered pellet gun.

An embodiment of this disclosure includes a rapid fire pellet gun having a pellet firing assembly, belt feed assembly, and belt storage. An air supply provides pressurized air or other fluid to a valve. The valve has a stem that is triggerable by a slide bolt. When the trigger is pulled, the slide block engages and opens the valve stem momentarily releasing a burst of fluid pressure.

This burst of fluid pressure, such as pressurized air, actually accomplishes multiple tasks. First, a substantial amount of the pressure is projected forward towards a pellet firing the same out of the barrel of the gun. Second, another quantity of the pressurized air is blown back against the bolt to reset it in a cocked position to fire again. And third, a quantity of air is directed to the feed mechanism to advance the belt.

In one illustrative embodiment, when the valve is discharged firing a pellet, fluid enters a check valve assembly supplying pressure to the feed assembly. A piston, as part of that feed assembly, pushes against the bias of a spring to rotate a pivot arm. That rotation illustratively converts into linear movement by sliding a block in the feed mechanism. The sliding block is configured to move and seat the belt links holding the pellets. Illustratively using spring loaded pawls above and below the link, the sliding block advances each link into the firing position. The lower pawl illustratively has a channel that lifts and holds the link in the proper firing position.

Once the firing has taken place and the gas expended, the spring in the feed mechanism pushes the piston back, rotating the pivot arm back, and moving the slide block back to where it started. As this happens, the top spring loaded pawl engages the next link in line and pushes it to the firing position. The expended link is pushed out of the feed mechanism. This cycle continually repeats so as long as there is a sufficient fluid supply.

In order to time the pellet's firing with its position in the mechanism, the feed mechanism is coupled to the firing assembly. In an illustrative embodiment, a top sear trigger engages the pivot arm used to help advance the links. The illustrative end of the sear trigger is moveable along a slot inside the pivot arm, so the aim can again translate rotational movement to linear movement of that trigger. In order to fire the gun, an illustrative top sear must be disengaged from the firing bolt. A catch in that bolt engages the sear until the sear is tripped. Illustratively, after the bolt engages the valve stem it is blown back and the top sear will engage the catch holding the bolt in a "cocked" position while the feeder is ejecting the spent link and advancing the next link. As the pivot arm rotates the link into the firing position, the illustrative linear slot moves the top sear trigger to disengage the top sear held against the bolt. Because the bolt is under spring tension, when released it will move to engage the valve stem again supplying another blast of air. This fires another pellet and initiates recycling the link. This process continues until the finger trigger is no longer depressed, or the fluid or air pressure is spent.

Another illustrative embodiment of the present disclosure provides a method of firing a less-than-lethal pellet gun. The method comprises the steps of: providing a plurality of links each holding a pellet configured to be fired through a barrel of the pellet gun; providing a feed cylinder to advance the links to a firing position and ejecting each link after its pellet has been fired; activating a trigger which causes a bolt attached to a linkage arm to linearly move, wherein the feed cylinder includes a slot portion and a gear portion, wherein the slot portion includes a first slot region, a second slot region, a first angled slot region, and a second angled slot region, wherein a portion of the linkage arm engages the slot portion of the feed cylinder such that the linear movement of the linkage arm causes the portion of the linkage arm to travel along the first and second slot and first and second angled slot regions rotating the feed cylinder, and wherein at least one of the plurality of links engages a portion of the gear portion of the feed cylinder; rotating the feed cylinder to move one of the plurality of links holding the pellet to a firing position; releasing a sear from a notch in the bolt; biasing against the bolt from a spring to move the bolt until it engages a stem which releases fluid from a container into a valve and toward the link; firing the pellet from the release of fluid through the valve; supplying fluid back through a portion of the valve to move the bolt against the bias of the spring to reset the gun to a ready-to-fire position; moving the linkage arm through the second angled slot and first slot portions after the pellet is fired to eject the one link the pellet was fired from and replace with a second link; and engaging both trigger and notch in the bolt by the sear after the pellet has fired to hold the bolt away from the stem which closes the valve to prepare the gun to fire again.

In the above and other illustrative embodiments, the method of firing the less-than-lethal pellet gun further comprises the steps of: offsetting the first and second slot regions from each other, wherein the feed cylinder does not rotate as the linkage arm travels in slot regions, wherein as the portion of the linkage arm is engageable with the first angled portion causing the feed cylinder to rotate in one direction, and when the portion of the linkage arm moves in another direction, it engages the second angled portion; the gear portion includes front lobes separated by front channels and rear lobes separated by rear channels, wherein one of the plurality of links sits in the front and rear channels such that as the feed cylinder rotates, so too does the plurality of links; the gear portion of the feed cylinder further comprising a plurality of detent edges such that a spring is engageable with one of the detent edges to limit rotational movement of the feed cylinder; moving the bolt by the bias of the spring after the gun has fired to move a terminal portion of the linkage arm in the second slot region of the feed cylinder; moving the terminal portion of the linkage arm in a second angled slot region after moving in the second slot region; moving the terminal portion of the linkage arm in the first slot region after moving in the second angled slot region; returning the trigger to its ready-to-fire position by the steps of: providing a response trigger system which receives air from the container which moves a piston toward the trigger after the pellet is fired, wherein pulling the trigger biases against the piston pushing it to a cylinder, fluid then bleeds back through a flow control valve to the valve; providing a fitting that is in fluid engagement with the valve, wherein a gap receives fluid when the bolt moves the stem, wherein the gap is also in fluid communication with the fitting which receives the fluid, wherein the fluid travels through the tube and into the flow control valve, wherein a fitting attaches to a flow control body and is in fluid communication therewith so fluid from the valve travels through a tube and fitting and into a cylinder, wherein fluid pressure accumulates in the cylinder pushing the piston against the trigger back to the ready-to-fire position; the method of firing the gun may further comprise movement of response trigger system being adjustable so the firing rate of the pellet gun can be changed; returning the gun to the ready-to-fire condition by moving the bolt away from the stem of the valve which concurrently moves the linkage arm which rotates the feed to move another link; the feed cylinder rotates in about 22.5 degree increments; as the front and rear lobes continue to rotate as the feed cylinder continues to rotate, additional links are drawn into the pellet gun to be fired; and a spring abuts against a detent edge on the feed cylinder to prevent the feed cylinder from freely rotating in a direction.

Another illustrative embodiment of the present disclosure provides a less-than-lethal pellet gun that comprises: a plurality of links each holding a pellet and configured to be fired through a barrel of the pellet gun; a feed cylinder configured to advance the links to a firing position and eject each link after its pellet has been fired; a trigger configured to cause a bolt attached to a linkage arm to move linearly; wherein the feed cylinder includes a slot portion and a gear portion; wherein the slot portion includes a first slot region, a second slot region, a first angled slot region, and a second angled slot region; wherein a portion of the linkage arm is configured to engage the slot portion of the feed cylinder such that linear movement of the linkage arm causes the portion of the linkage arm to travel along the first and second slot and first and second angled slot regions to rotate the feed cylinder; wherein at least one of the plurality of links is configured to engage a portion of the gear portion of the feed cylinder; wherein the feed cylinder is configured to move one of the plurality of links holding the pellet to a firing position; a sear configured to selectively release from a notch in the bolt; wherein the bolt is configured to bias against a spring to move the bolt until it engages a stem which is configured to release fluid from a container into a valve and toward the link to fire the pellet; wherein the gun is configured to supply fluid back through a portion of the valve to move the bolt against the bias of the spring to reset the gun to a ready-to-fire position; wherein the linkage arm is configured to move through the second angled slot and first slot portions after the pellet is fired to eject the one link the pellet was fired from and replace with a second link; and wherein both trigger and notch in the bolt is configured to be engaged by the sear after the pellet has fired to hold the bolt away from the stem which closes the valve to prepare the gun to fire again.

In the above and other illustrative embodiments, the less-than-lethal pellet gun may further comprise: the first and second slot regions being offset from each other, wherein the feed cylinder is configured not to rotate as the linkage arm travels in slot regions, wherein the portion of the linkage arm that is engageable with the first angled portion is configured to rotate the feed cylinder in one direction, and the portion of the linkage arm is movable in another direction and engages the second angled portion; the gear portion further comprises front lobes separated by front channels and rear lobes separated by rear channels, wherein one of the plurality of links sits in the front and rear channels such that as the feed cylinder rotates, so too does the plurality of links; the gear portion of the feed cylinder further comprises a plurality of detent edges such that a spring is engageable with one of the detent edges to limit rotational movement of the feed cylinder; the bolt being configured to move by the bias of the spring after the gun has fired to move a terminal portion of the linkage arm in the second slot region of the feed cylinder; and configured to move the terminal portion of the linkage arm in second angled slot region after moving in the second slot region; and configured to move the terminal portion of the linkage arm in the first slot region after moving in the second angled slot region; the trigger being configured to return to its ready-to-fire position by a response trigger system configured to receive fluid from the container which moves a piston toward the trigger after the pellet is fired; wherein pulling the trigger biases against the piston pushing it to a cylinder; fluid then bleeds back through a flow control valve to the valve; and a fitting that is in fluid engagement with the valve, wherein a gap receives fluid when the bolt moves the stern, wherein the gap is also in fluid communication with the fitting which receives the fluid, wherein the fluid travels through the tube and into the flow control valve, wherein a fitting attaches to a flow control body and is in fluid communication therewith so fluid from the valve travels through a tube, a fitting, and into a cylinder, wherein fluid pressure accumulates in the cylinder pushing the piston against the trigger back to the ready-to-fire position; movement of the response trigger system being adjustable so the firing rate of the pellet gun can be changed; the gun being configured to return to the ready-to-fire condition by moving the bolt away from the stem of the valve which concurrently moves the linkage arm which rotates the feed to move another link; the feed cylinder being configured to rotate in about 22.5 degree increments; the front and rear lobes being configured to continue to rotate as the feed cylinder rotates to draw additional links into the pellet gun to be fired; and a spring being configured to abut against a detent edge on the feed cylinder to prevent the feed cylinder from freely rotating.

Additional features and advantages of the pellet gun will become apparent to those skilled in the art upon consideration of the following detailed descriptions exemplifying the best mode of carrying out the pellet gun as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the pellet gun, and such exemplification is not to be construed as limiting the scope of the pellet gun in any manner.

DETAILED DESCRIPTION OF THE DRAWINGS

Figure 1:
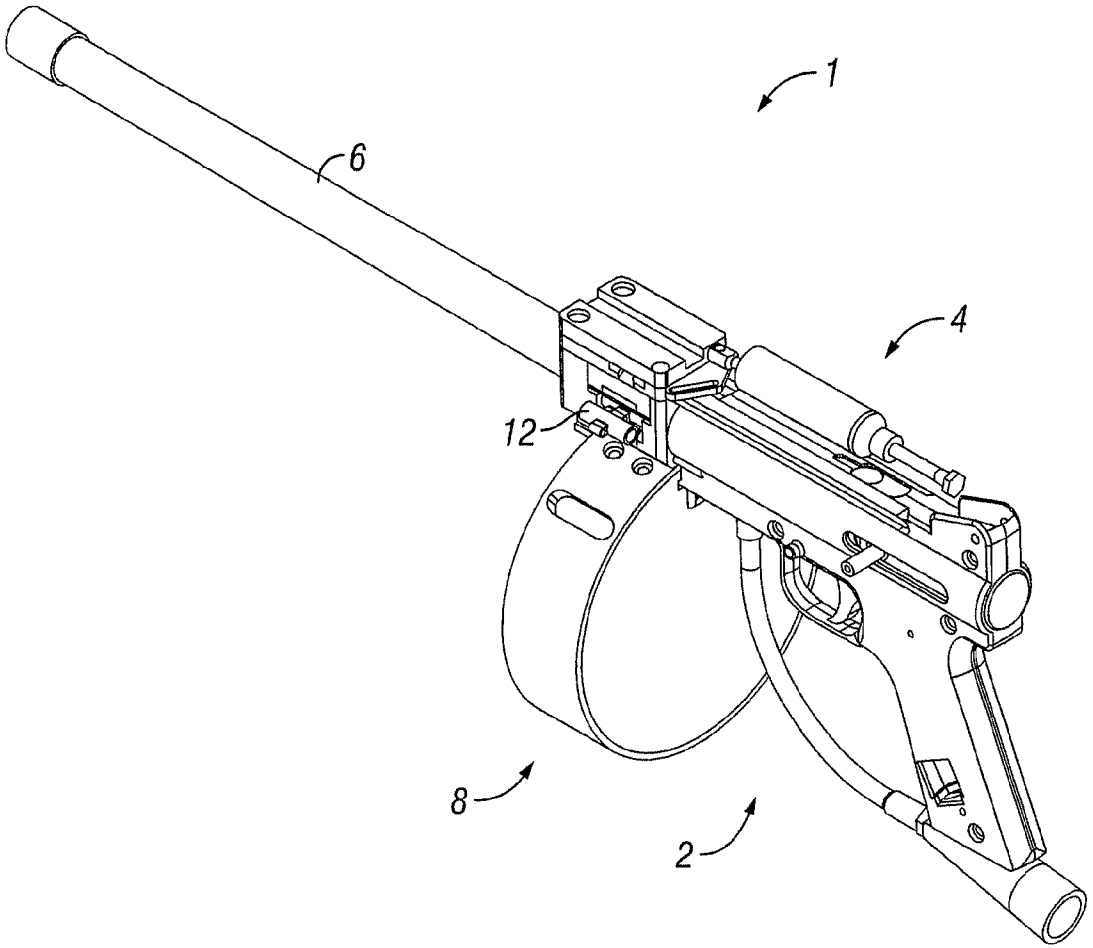
FIG. 1 is a perspective view of an air powered, less-than-lethal pellet gun according to an illustrative embodiment of the present disclosure.

A perspective view of an air powered automatic less-than-lethal pellet gun 1 is shown in FIG. 1. In this embodiment, gun 1 includes a firing mechanism 2, a feeder mechanism 4, a barrel 6, and belt storage 8.

An illustrative embodiment of this gun enables the user to press and hold trigger 10 to create a rapid firing of pellets from gun 1. Link 12 illustratively exits holder 8 and enters into feed mechanism 4. The pellet is shot and link 12 is then discharged from mechanism 4. In an illustrative embodiment, holder 8 may accommodate a belt of approximately 120 links with a pellet fitted in each link. With a large enough and constant fluid supply, all of these pellets can be fired in rapid succession by simply holding down trigger 10.

Figure 2:
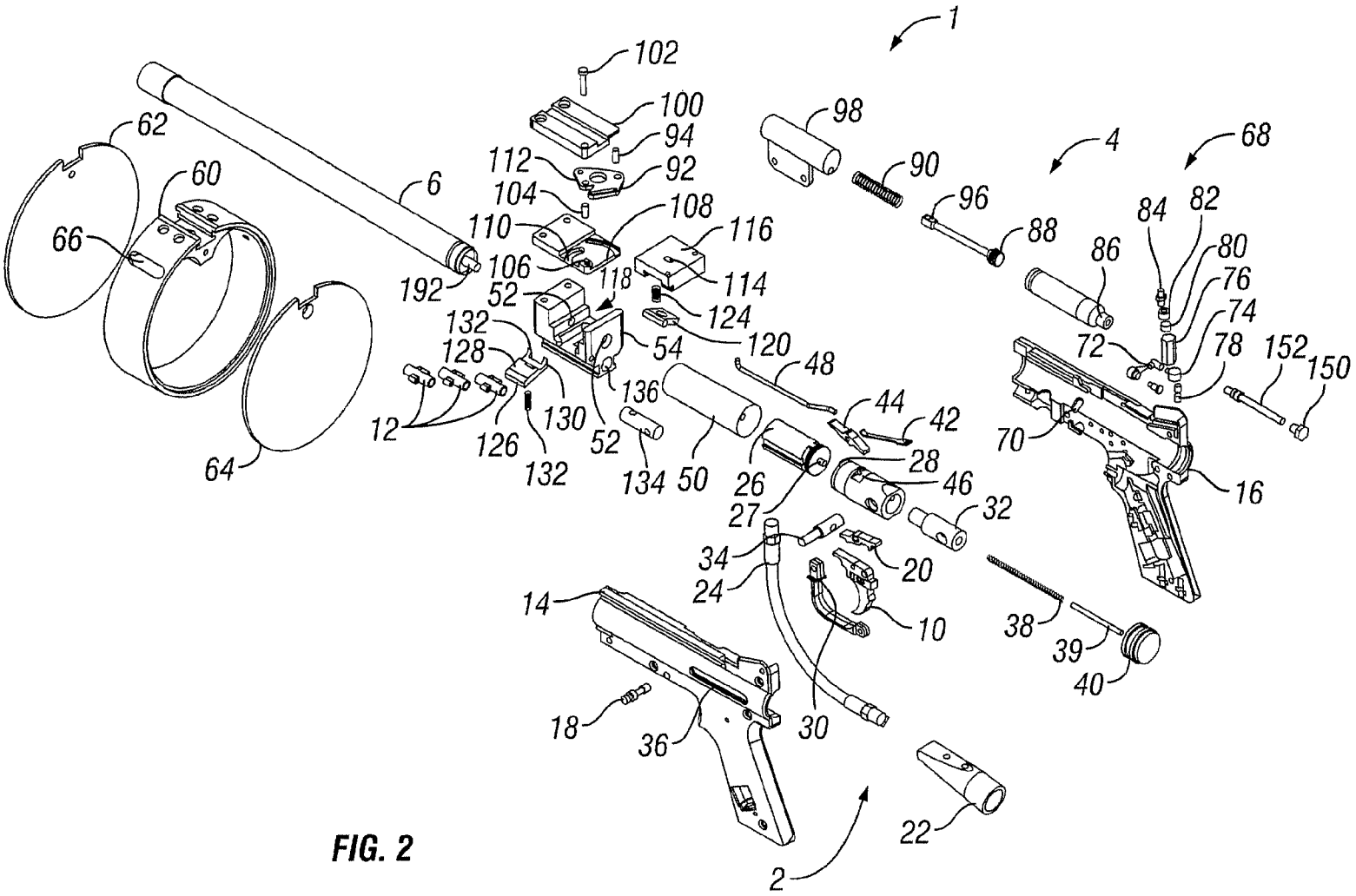
FIG. 2 is an exploded perspective view of the gun of FIG. 1.

An exploded view of gun 1 is shown in FIG. 2. This embodiment includes a left receiver 14 and right receiver 16 combined to make the casing for the handle and firing mechanism. Safety 18 operating in conventional manner prevents activation of trigger 10 when engaged. Tank adapter 22 secures the fluid source to gun 1. It is appreciated that the fluid source may be air, $CO_2$, nitrogen or other similar or adequate pressurized gas. The gas may travel from tank adaptor 22 through line 24 and into valve 26. This valve is the component that releases the fluid into firing mechanism 2. While firing the pellet, fluid is also supplied into feed mechanism 4. A trigger guard 30 attaches to receivers 14 and 16 to shield trigger 10. In this illustrative embodiment, a bolt plug 32 is fitted within bolt 28. A handle 34 may illustratively attach to bolt 28 as well and extend out of slot 36 of receiver 14 to manually cock the gun. A drive spring 38 engages bolt plug 32 and bolt 28 biasing the structures toward valve 26. A drive spring guide 39, disposed in the spring, engages cap 40 which attaches to receivers 14 and 16 creating a fixed distance between itself and valve 26. A top sear spring 42 engages the top sear 44 creating a constant pressure against sear 44 towards bolt 28. In this illustrative embodiment, bolt 28 includes a notch 46 configured to receive sear 44 for holding bolt 28 in place until sear trigger 48 releases sear 44. Valve 26 is disposed in power tube 50 which focuses fluid through bore 52 and feeds block 54. Bore 52 is in communication with bore 192 of barrel 6 through which a pellet from link 12 will fire. Also shown is drum housing 60 with end caps 62 and 64 for holding a belt of pellet rounds. A belt of links 12 exit housing 60 through an opening 66 and feed into feed block 54.

Feeder mechanism 4 includes a valve assembly 68 that supplies fluid from valve 26 through opening 70 and out to a piston supply hose 72 coupled to illustrative banjo fitting 74 which attaches to check valve body 76 via illustrative banjo screw 78. Check valve 80 is further disposed in check valve body 76, with check valve bushing 82 in piston supply fitting 84 located in piston body 86. A piston 88 disposed in body 86 engages spring 90 and is coupled to pivot arm 92 via illustrative pin 94 disposable in opening 96 of piston 88. A piston mounting bracket 98 is attachable to receiver 16 and receives piston body 86. A cover 100 attaches to feeder body 54 via fasteners 102. A pivot pin 104 is disposable in opening 106 of feed slide cover plate 108. Slide cover plate 108 illustratively includes a curved cam slot 110 configured to receive a peg 112 that extends from pivot arm 92. Peg 112 is configured to engage opening 114 in slide block 116 moving slide block 116 within cavity 118 of feeder body 54. A top feed pawl 120 is hingedly attached to feeder slide 116, biasing away from the same via spring 124. Bias from spring 124 acts on pawl 120 to bias pawl 120 away from block 116. A bottom pawl 126 is illustratively hingedly attached in cavity 118 of feeder body 54. An illustrative channel 128 and retainers 130 are located on bottom pawl 126. Pawl 126 is also spring loaded via spring 132 so it can move out of the way while a link 12 is advancing out of the gun. A dowel 134 is engageable with bore 136 disposed in body 54 engageable with receivers 14 and 16 so body 54 will not rotate. A manual reset shaft and button 152 and 150, respectively, acts on piston 88 to advance feed mechanism 4 under loss of power.

Figure 3:
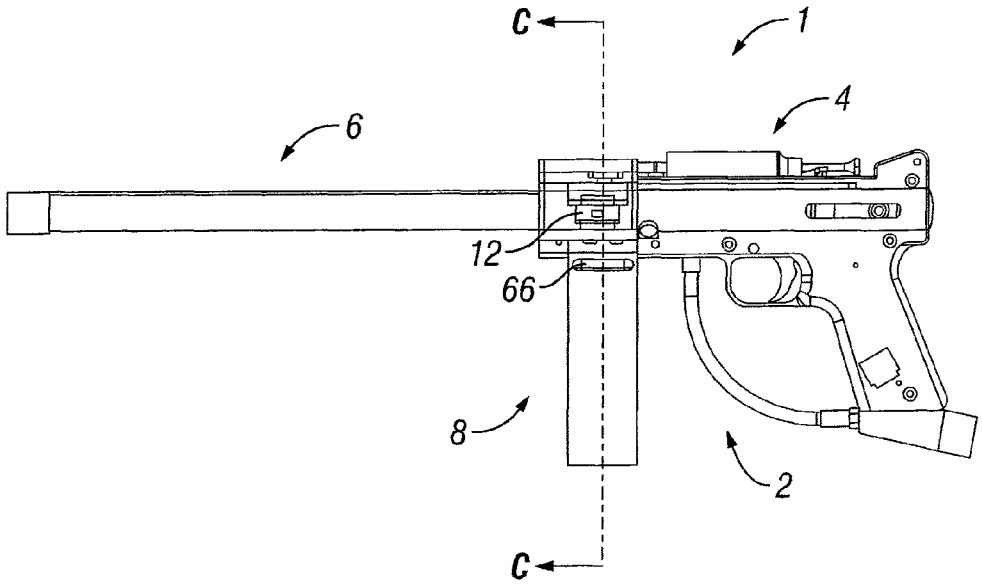
FIG. 3 is a side view of the gun of FIG. 1.

A side view of gun 1 is shown in FIG. 3. This view further shows firing mechanism 2, feed mechanism 4, belt storage 8, and barrel 6. It is appreciated that links 12 that form a belt each contain a pellet and exit storage 8 through opening 66 to enter feed mechanism 4.

Figure 4:
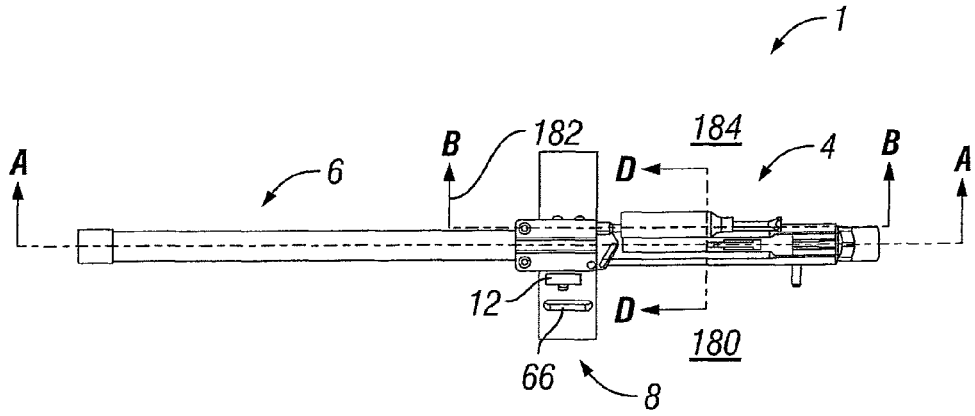
FIG. 4 is a top view of the gun of FIG. 1.

A top view of gun 1 is shown in FIG. 4. This view shows feeder mechanism 4, belt storage 8, and barrel 6. This view also shows the illustrative direction links 12 travel. In this embodiment, links 12 exit opening 66 on side 180 of gun 1. The links are drawn in via feeder mechanism 4 and eject therefrom on side 184 of gun 1. It is appreciated that gun 1 is configured to feed links 12 each containing a pellet through feed mechanism 4 until the belt is exhausted of links 12, or gun 1 runs out of fluid power.

Figure 5:
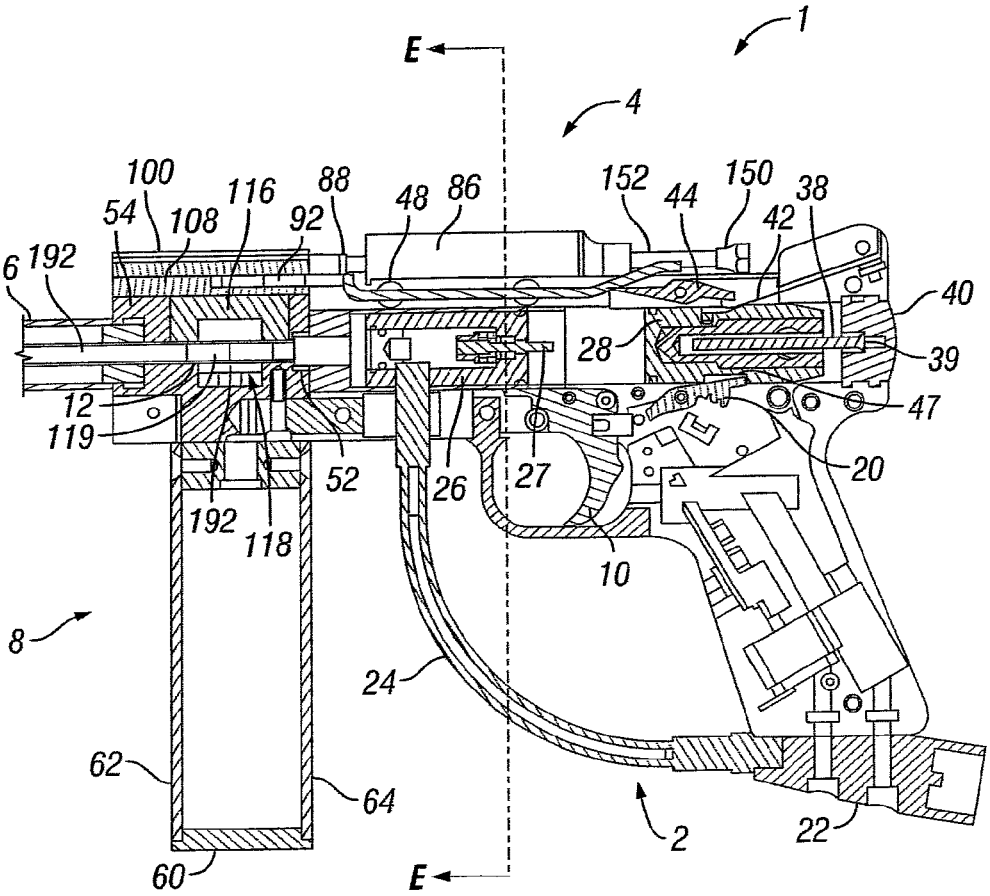
FIG. 5 is a side cross-sectional view of the gun of FIG. 1 taken along line A-A of FIG. 4 in a ready-to-fire condition.

A side cross-sectional view of a portion of gun 1, taken along line A-A of FIG. 4, is shown in FIG. 5. This view shows gun 1 in a ready-to-fire position. No pellet, however, has been fired since trigger 10 has not been pulled. In this condition, bolt 28 is in the "cocked" position meaning that it will be ready to fire when trigger 10 is pulled. From this view, bottom sear 20 is engaged with both trigger 10 and notch 47 in bolt 28. This holds bolt 28 away from stem 27 of valve 26 against the bias force of spring 38. Top sear 44 is disengaged from bolt 28. Valve 26 is in the closed position so no fluid from tube 24 is yet entering the firing mechanism 2. This view also shows link storage 8 with drum covers 62 and 64 covering drum housing 60. Hollow link 12 with pellet 119 inside is aligned with bore 192 inside barrel 6 and opening 52 in cavity 118 of feeder body 54. Also shown in this view are feed slide 116, cover 26, pivot arm 92 and feed slide cover plate 108. Manual actuator shaft and button 152 and 150, respectively, are also shown in this view. It is appreciated that depressing this shaft can act on piston 88 to clear a link.

Figure 6:
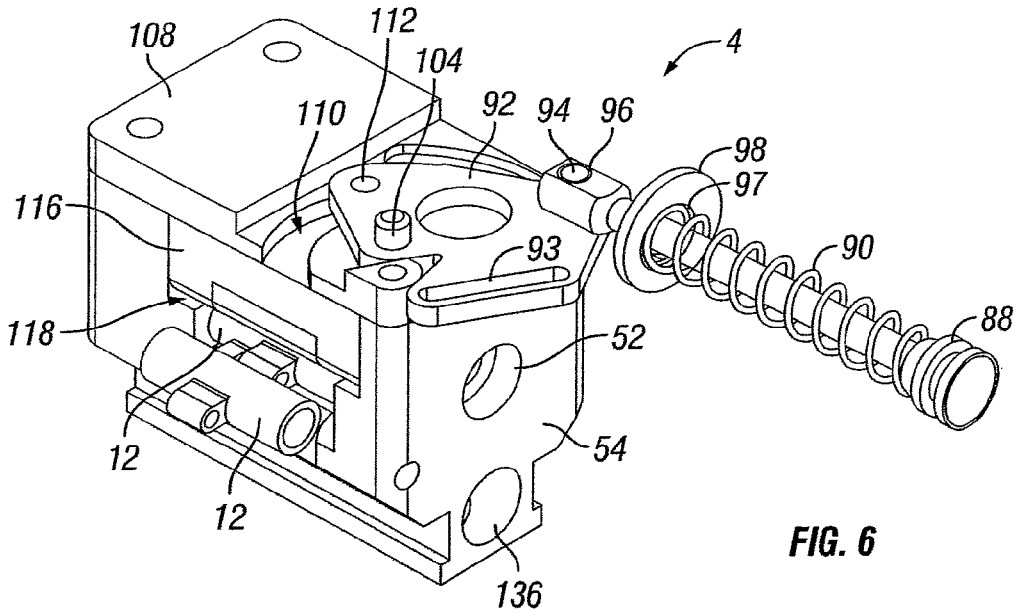
FIG. 6 is an isolated perspective view of a feed mechanism illustratively used in the gun of FIG. 1.

To better understand the positioning of feed mechanism 4, an isolated perspective view of feed mechanism 4 is shown in FIG. 6. In this view piston 88 is in the back position held in place by the bias of spring 90. Opening 96 of piston 88 receives pin 94 allowing a pivotable connection between piston 88 and pivot arm 92. It is appreciated that piston 88 is disposed through an oversized opening 97 formed in the end portion of mounting bracket 98. This allows some lateral or side-to-side movement or tolerance of piston 88 while it is moving pivot arm 92. Pin 112 is disposed in cam slot 110 of cover plate 108. This view further shows slide block 116 fitted inside cavity 118 of feed block 54. Links 12 are also shown in this view positioned in cavity 118 of block 54. As previously discussed, in this position a pellet 119 is aligned with openings 52 in feed block 54.

Figure 7:
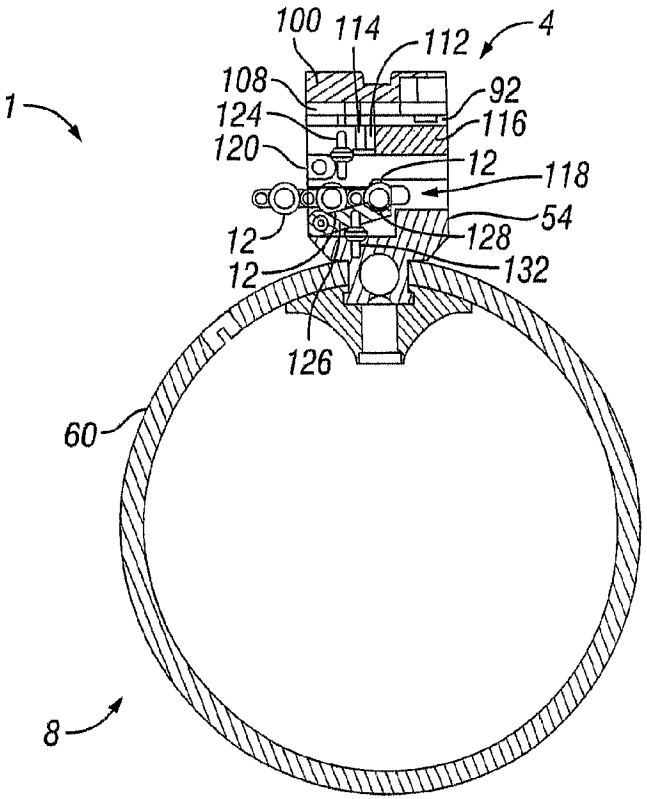
FIG. 7 is a cross-sectional end view of the feed mechanism taken along line C-C of FIG. 3 in a ready-to-fire condition.

A cross-sectional end view of feed mechanism 4 taken along line C-C of FIG. 3 is shown in FIG. 7. This view shows additional details inside feed block 54. For example, this view shows link 12 located in the center of feed block 54 in the firing position. Upper pawl 120, by virtue of spring 124, biases toward link 12 holding it in place. Similarly, bottom pawl 126 is biased upward by virtue of spring 132 cradling link 12 in channel 128. These spring-loaded pawls help keep links 12 in a proper position while also being movable to help advance the next link into firing position while ejecting the spent link. This view also shows pin 112 disposed in slot 114 of slide block 116. In this view drum housing 60 is attached to feed block 54 and cover 100 capping pivot arm 92.

Figure 8:
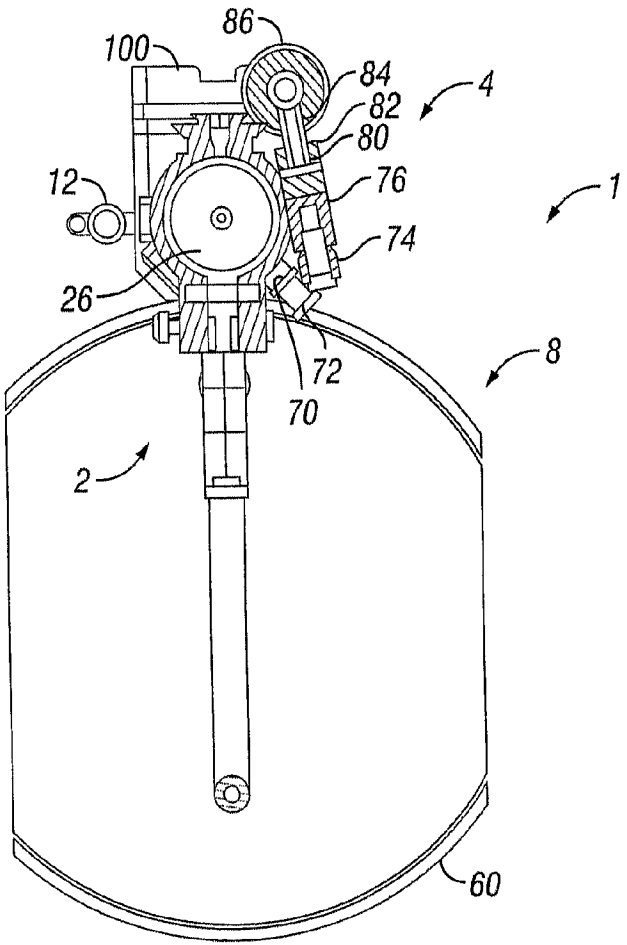
FIG. 8 is a cross-sectional view of a portion of the gun of FIG. 1 taken along line D-D of FIG. 4 in the ready-to-fire condition.

A cross-sectional view of a portion of gun 1 taken along line D-D of FIG. 4 is shown in FIG. 8. This view shows the configuration of the airflow path from firing assembly 2 to feed mechanism 4. Hose 72 connects to the interior of firing mechanism 2 via opening 70 so fluid escaping valve 26 can exit through opening 70 up through hose 72 through fitting 74, body 76, check valve 80, bushing 82 and fitting 84 to deposit into body 86 to supply pressure to piston 88.

Figure 9:
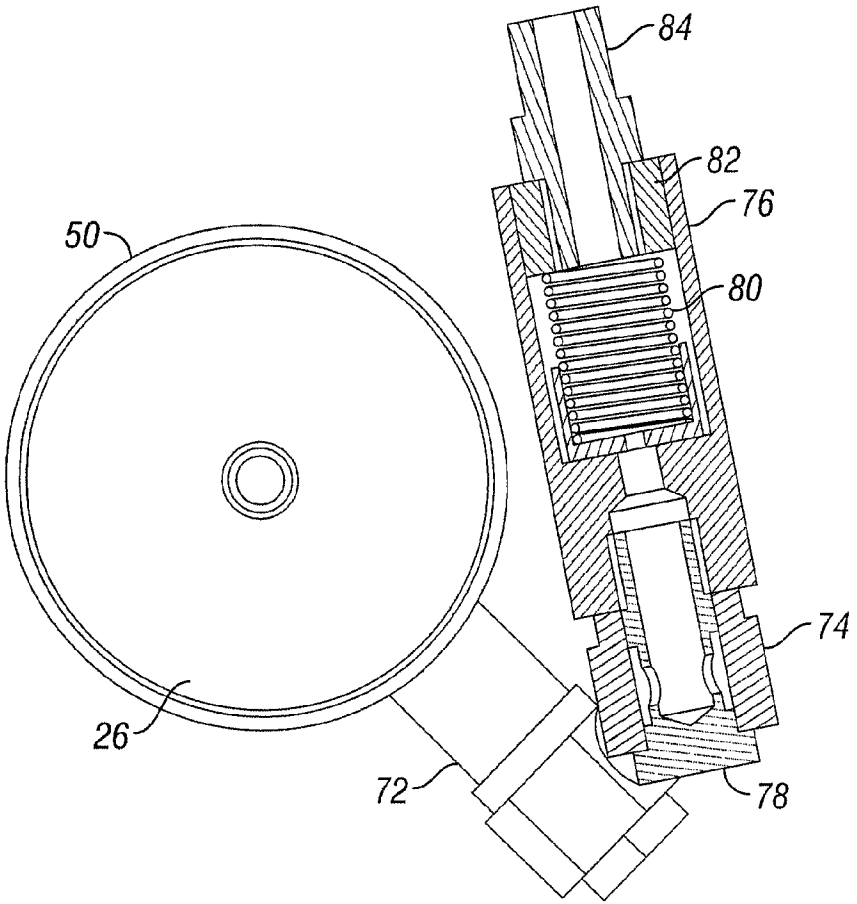
FIG. 9 is a detailed view of components of the gun of FIG. 1.

A detailed view of tube 50, housing valve 26, and the structure supplying fluid up to feed assembly 4 is shown in the detailed view of FIG. 9. As this view shows, because fluid has not yet been released by valve 26, check valve 80 is in the closed position. It is appreciated that the passageway formed by structures 72 through 40 are configured to allow a greater volume of air to flow up from valve 26 to cylinder 86 than flow in reverse from cylinder 86 back to firing mechanism 2. It is appreciated that check valve 80 can have an orifice allowing some air to escape while even in the closed position. This allows the air to bleed out at a controlled rate.

Figure 10:
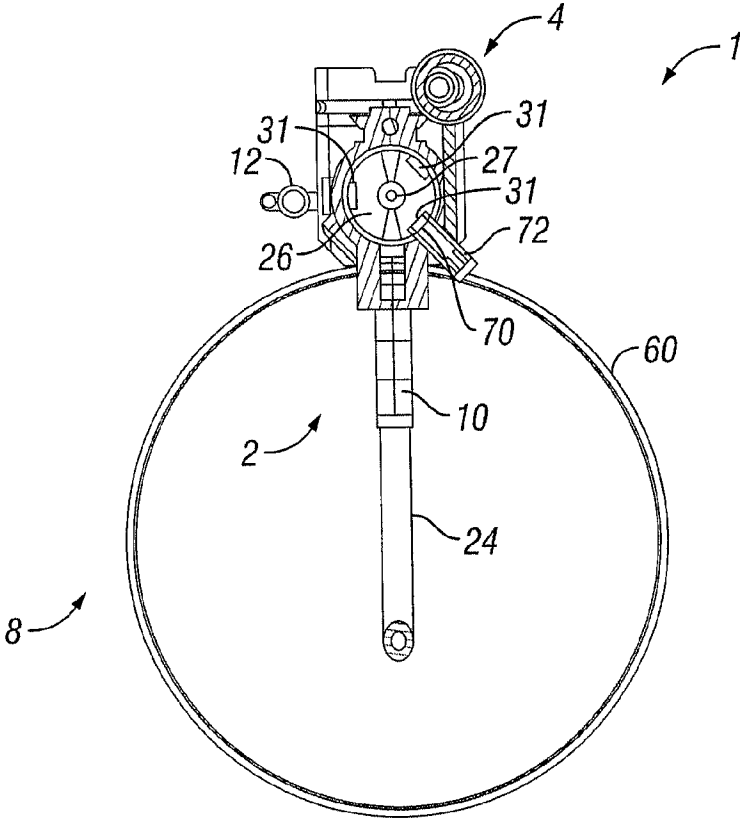
FIG. 10 is a cross-sectional end view of a firing mechanism portion of the gun of FIG. 1 taken along line E-E of FIG. 5.

A cross-sectional end view of firing mechanism 2 taken along line E-E of FIG. 5 is shown in FIG. 10. This view illustratively shows fluid flow access when air is released by valve 26. When stem 27 is depressed, air flows out channels 31 to force pellet 119 through bore 192 and out barrel 6. Some additional fluid pressure, however, is released around stem 27 to blow bolt 28 back to its pre-firing position. Additional fluid is supplied through opening 70 and out piston supply hose 72 to feed fluid up to feed assembly 4 for powering piston 88.

Figure 11:
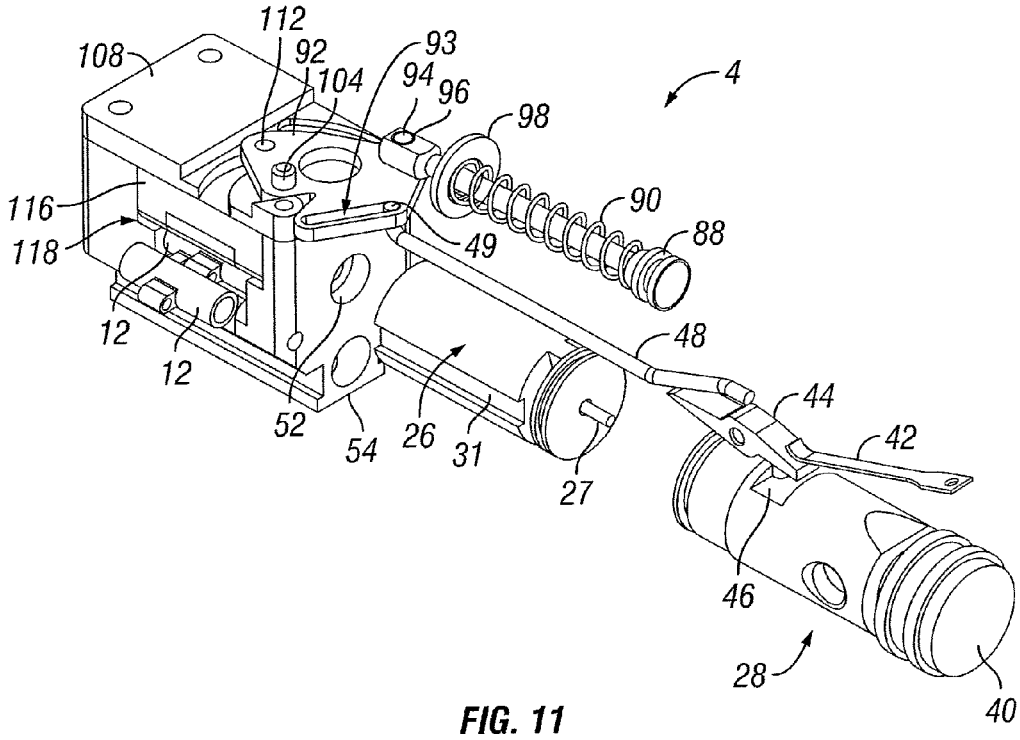
FIG. 11 is a perspective detailed view of a mechanism, valve and bolt portions of the gun of FIG. 1.

A perspective detail view of mechanism 4 along with valve 26 and bolt 28 is shown in FIG. 11. In this ready-to-fire position bolt 28 is spaced apart from stem 27 of valve 26. This means no fluid pressure is entering the system. Rather, bolt 28 is positioned adjacent cap 40 and is being held by lower sear 20, as shown in FIG. 5. Upper sear trigger 48 includes a pin portion 49 disposed in cam slot 93 of pivot arm 92. This linkage allows feed mechanism 4 to serve as a timing feature so that once a round is fired, the spent link 12 can be ejected and a new link 12 with pellet 119 inside moves into the firing position before bolt 28 re-engages stem 27 to fire again. In this particular configuration, however, trigger 48 is not causing upper sear 44 with spring 42 to engage notch 46 of bolt 28. Indeed, at this stage sear 44 remains out of the way of bolt 28.

Figure 12:
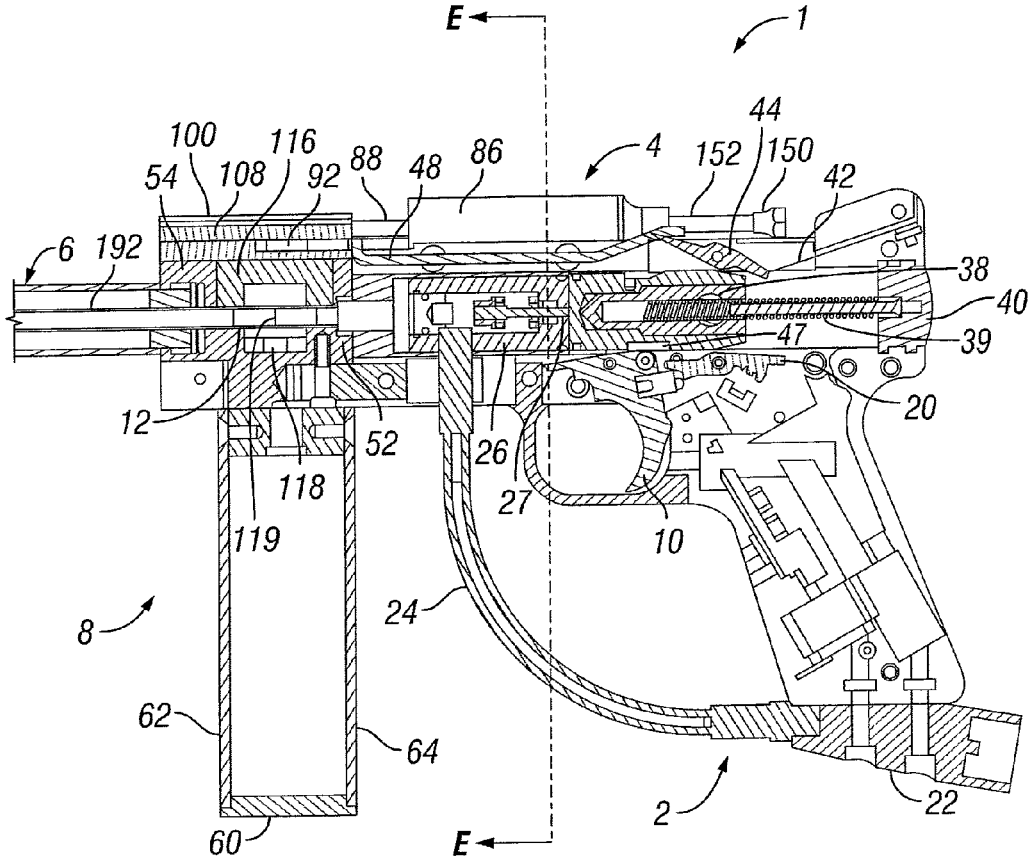
FIG. 12 is a side cross-sectional view of the gun of FIG. 1 taken along line A-A of FIG. 4 showing the gun in the firing condition.

Another side cross-sectional view taken along line A-A of FIG. 4 is shown in FIG. 12. This view is similar to the view in FIG. 5 except that now gun 1 is being fired. As shown in this view, trigger 10 is pulled in direction 220 releasing bottom sear 20 from notch 47 in bolt 28. Because the spring bias from spring 38 is disposed about spring guide 39 illustratively attached to cap 40, bolt 28 rapidly moves in direction 222 until bolt 28 engages and pushes stem 27 in direction 222 as well. This releases fluid from tube 24 and into valve 26. As previously discussed, this fluid travels in direction 222 to fire pellet 119 out of bore 192 of barrel 6. As also previously discussed, fluid at this point will be supplied to feed mechanism 4, as well as back through opening 31 which receives stem 27 causing bolt 28 to blow back in direction 222 against the bias of spring 38 to get bolt 28 into firing position again.

Figure 13:
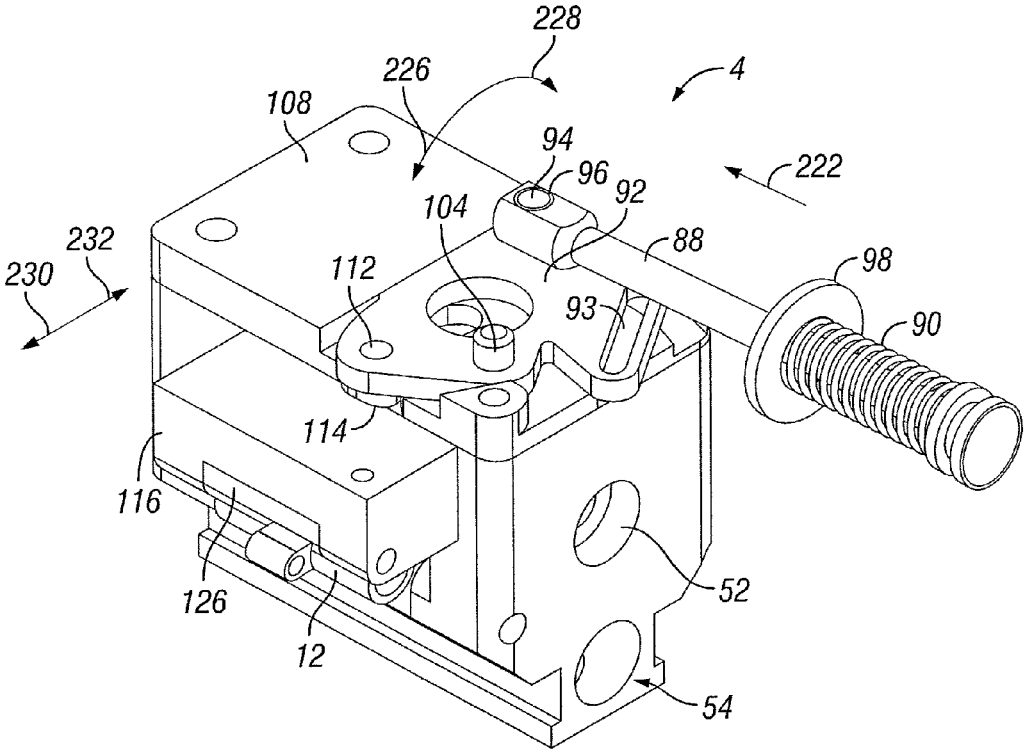
FIG. 13 is a detailed perspective view of the feed mechanism of FIG. 1 in the firing condition.

A detail perspective view of feed mechanism 4 is shown in FIG. 13. This view, similar to FIG. 6, now shows what happens to feed mechanism 4 while gun 1 is firing. In contrast to that shown in FIG. 6, fluid supplied from line 24 entering feed mechanism 4, as discussed with respect to FIGS. 8 and 9, acts on piston 88 moving the same in direction 222 against the bias of spring 90. Because of the pivoting linkage between pin 94 and opening 96, movement of piston 88 now moves pivot arm 92 as well. Pin 104, tying down one corner of pivot arm 92, assists converting the linear movement of piston 88 into rotational movement of pivot arm 92. In this illustrative embodiment, the pivot movement of arm 92 is in direction 226 which is an illustrative counter-clockwise direction. As pivot arm 92 rotates, pin 112 in slot 114 of slide block 116 pushes slide block 116 linearly in direction 230. In this illustrative embodiment, a portion of slide block 116 slides out of feeder body 54. At this point, the rotational movement of pivot arm 92 is being converted into linear movement of block 116.

Figure 14:
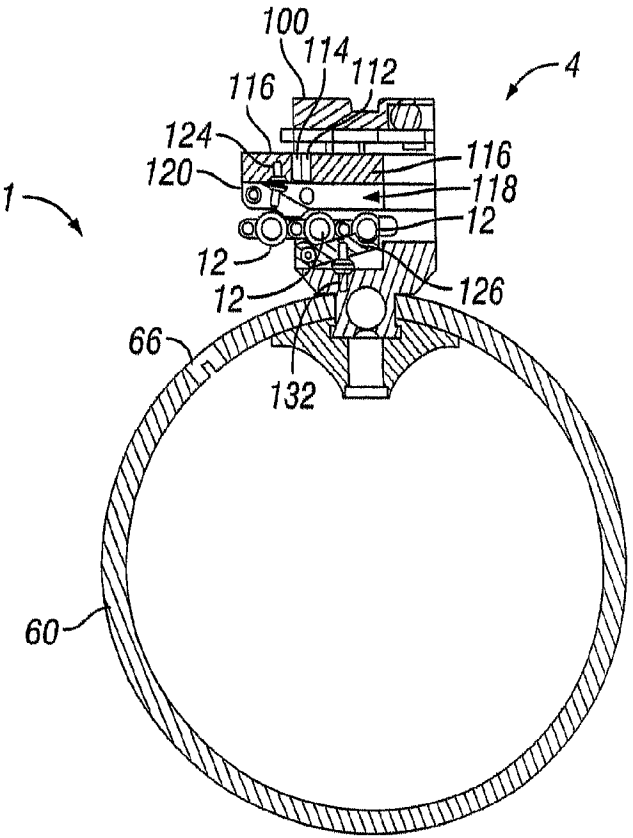
FIG. 14 is a cross-sectional view of the feed mechanism of the gun of FIG. 1 taken along line C-C of FIG. 3 shown in a firing condition.

A cross-sectional view of feed mechanism 4 is shown in FIG. 14 taken along line C-C of FIG. 3. This view is similar to that shown in FIG. 7, but now again with the gun firing. As this view shows, the particular link 12 being fired remains in position while block 116 is moving in direction 230. Movement of block 116 in this direction causes upper pawl 120 to snap over the next link 12, and snap back into position via spring 124. Being in this position, pawl 120 and block 116 are poised to push a new unfired link 12 in direction 232 and into the firing position.

Figure 15:
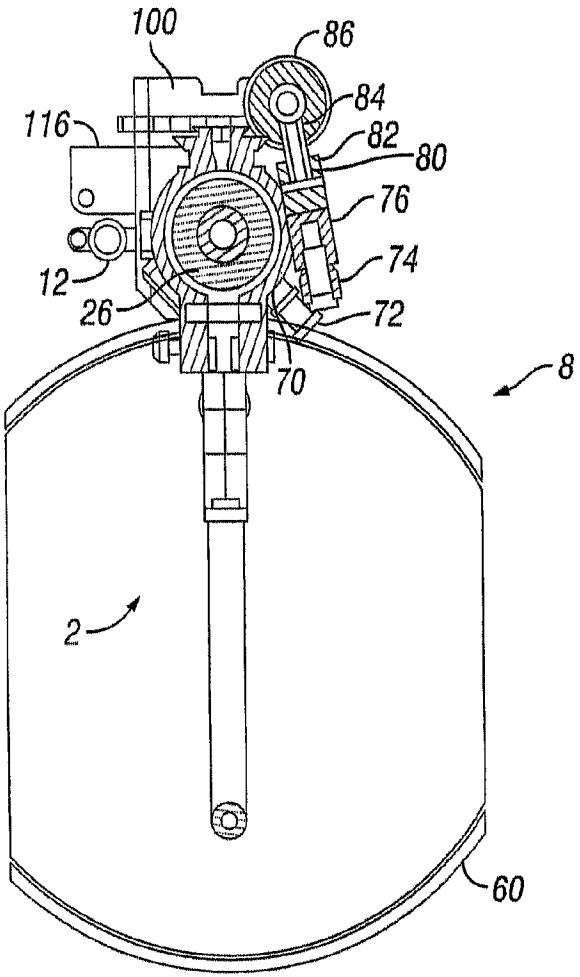
FIG. 15 is a cross-sectional end view of a portion of the gun of FIG. 1 taken along line D-D of FIG. 4 shown in the firing condition.
Figure 16:
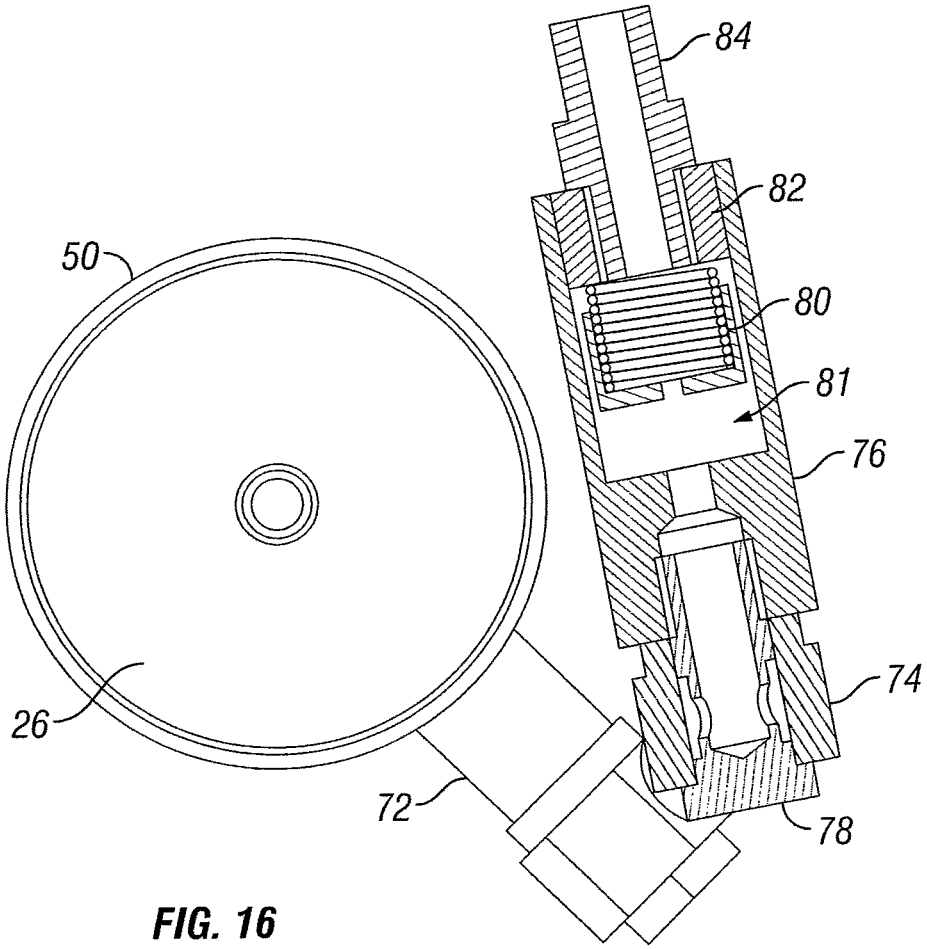
FIG. 16 is a detail view of the valve and related components of the gun of FIG. 1 shown in the firing condition.

A cross-sectional end view of a portion of gun 1 taken along line D-D of FIG. 4 is shown in FIG. 15. With the gun fired, air moves up through body 76 pushing an opening check valve 80 supplying air pressure to piston 88 of feed mechanism 4. The detail section view shown in FIG. 16 shows a gap 81 formed by check valve 80 moving upward allowing the air to flow to piston 88.

Figure 17:
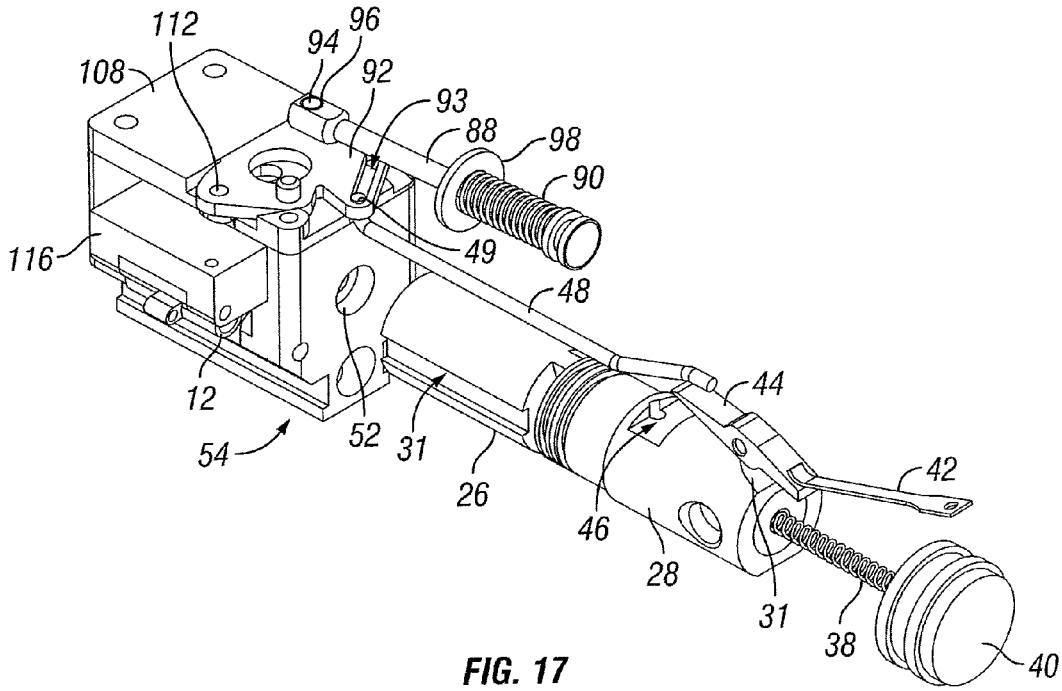
FIG. 17 is a perspective detail view of the mechanism, valve, and bolt shown in the firing condition.

A perspective detail view of mechanism 4 along with valve 26 and bolt 28 is shown in FIG. 17. This view, similar to FIG. 11, shows the position of these structures during firing of gun 1. As shown here, bolt 28 engages valve stem 27 under bias from spring 38 from cap 40. The rotation of pivot arm 92 moves pin portion 49 through slot 93 as shown. This moves top sear trigger 48, releasing top sear 44 which is now free to move to an engaged position under spring 42. Top sear 44, however, does not engage cavity 46 to hold bolt 28 yet, because bolt 28 is in the fired position. Rather, sear 44 is adjacent ramp 51 allowing bolt 28 to still move with respect to top sear 44.

Figure 18:
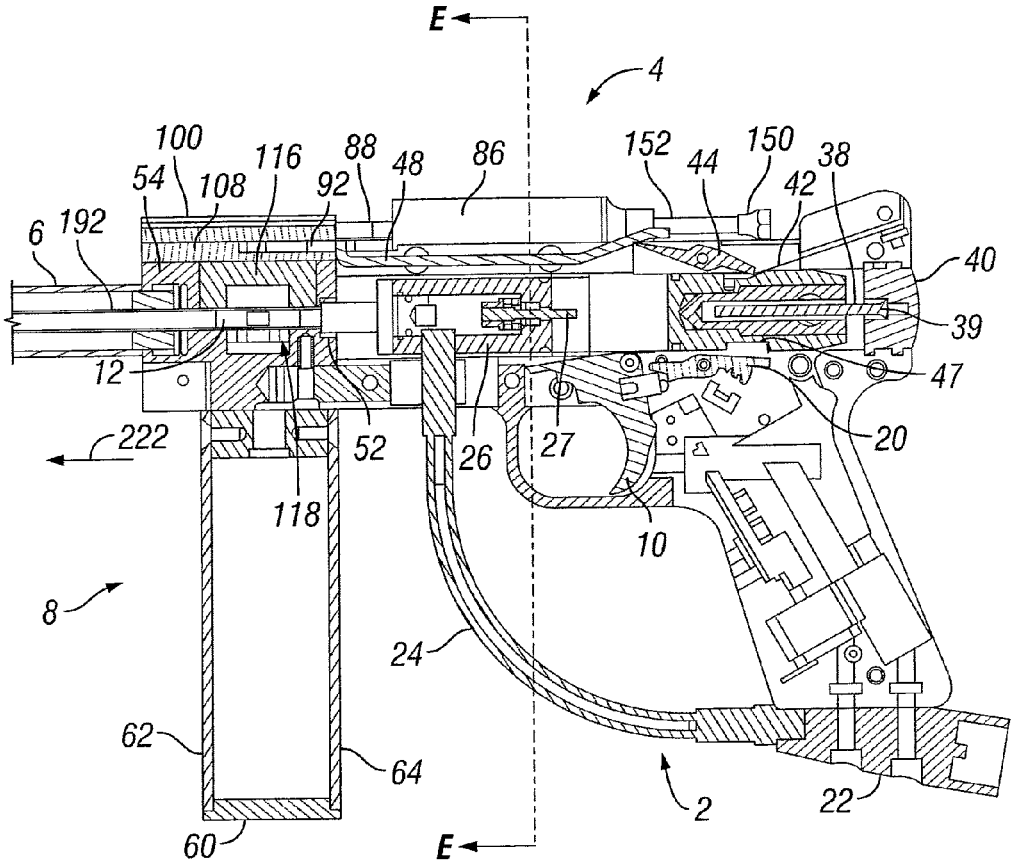
FIG. 18 is a side cross-sectional view of a portion of the gun of FIG. 1 taken along line A-A of FIG. 4 shown in an after-fired condition.

A side cross-sectional view taken along line A-A of FIG. 4 is shown in FIG. 18. This view is similar to the views in FIGS. 5 and 12, except in this case the gun has already fired once and feed mechanism 4 and firing assembly 2 are recycling to fire again. In this example, trigger 10 is still depressed maintaining bottom sear 20 clear from engaging bolt 28. Top sear 44 engages cavity 46 preventing bolt 28 from advancing in direction 222 to engage stem 27 of valve 26. Top sear trigger 48 is disengaged allowing top sear 44 to engage cavity 46.

Figure 19:
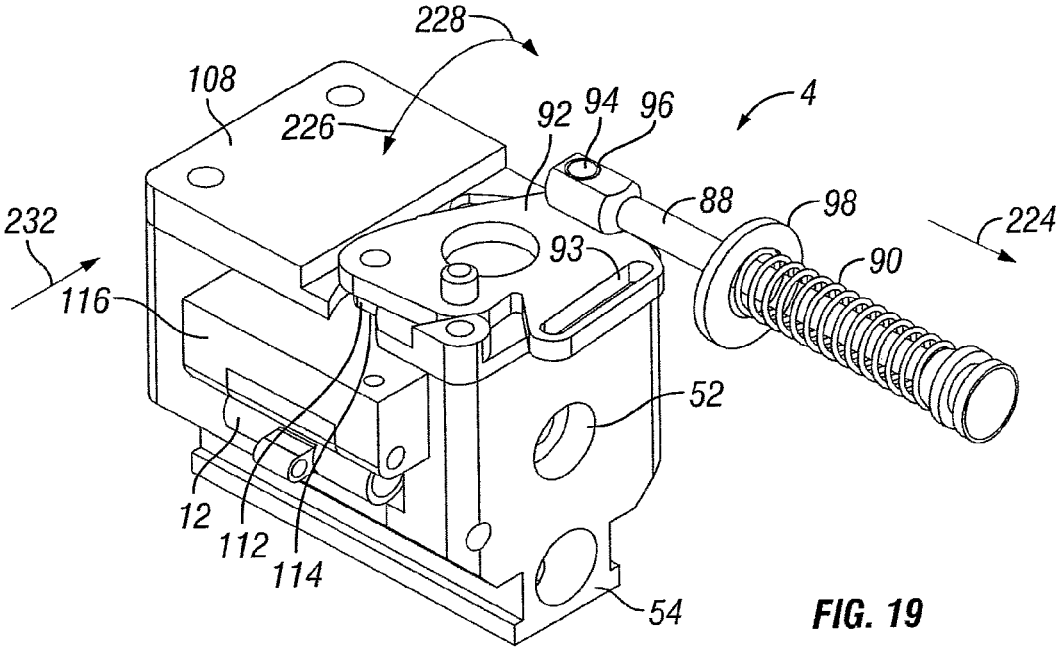
FIG. 19 is a perspective view of the feed mechanism from the gun of FIG. 1 shown in the after-fired condition.

A perspective view of feed mechanism 4, similar to that shown in FIGS. 6 and 13, is shown in FIG. 19. In this view, fluid pressure is now expended and releasing through valve 80 allowing spring 90 to move piston 88 back in direction of bias 220. That pivots pivot arm 92 in direction 228, in this case illustratively clockwise, causing pin 112 to pull block 116 back in direction 232 into feed block 54.

Figure 20:
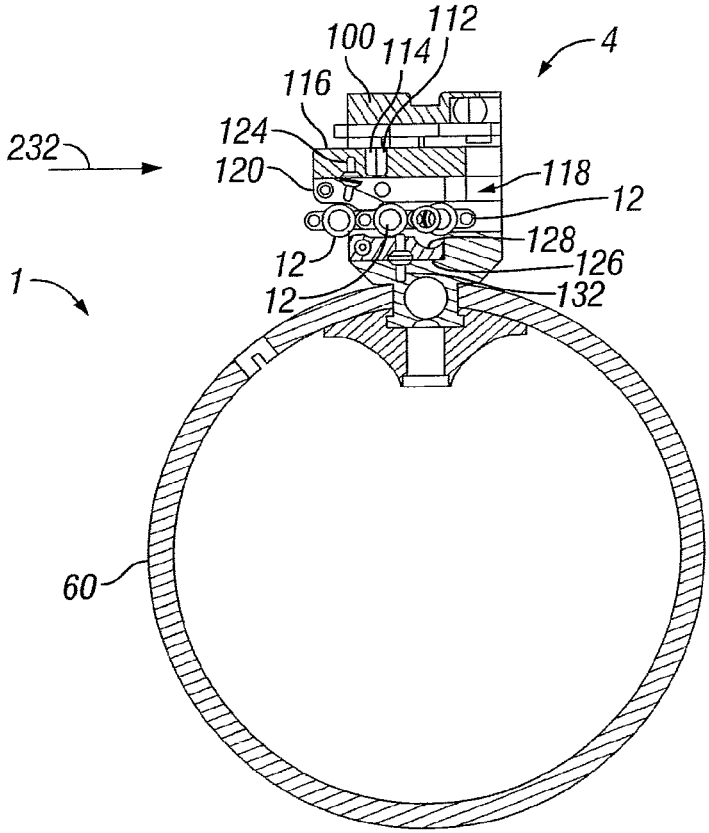
FIG. 20 is a cross-sectional view of the feed mechanism portion of the gun of FIG. 1 taken along line C-C of FIG. 3 shown in the after-fired condition.

A cross-sectional view of feed mechanism 4 taken along line C-C of FIG. 3 similar to the views shown in FIGS. 7 and 14 is shown in FIG. 20. Particularly contrasting this view to that of FIG. 14, pawl 120 is positioned apart from spent link 12 and is now adjacent the next non-spent link 12. As shown in FIG. 20, slide block 116 moves in direction 232 effectively pushing the next link 12 towards the firing position as shown in FIG. 7. Advancing a new link 12 toward the firing position causes lower pawl 126 to be pushed downward against the bias of spring 132, thereby lowering channel 128 and retainers 130 out of the way and allowing the spent link 12 to be pushed out of feed mechanism 4.

Figure 22:
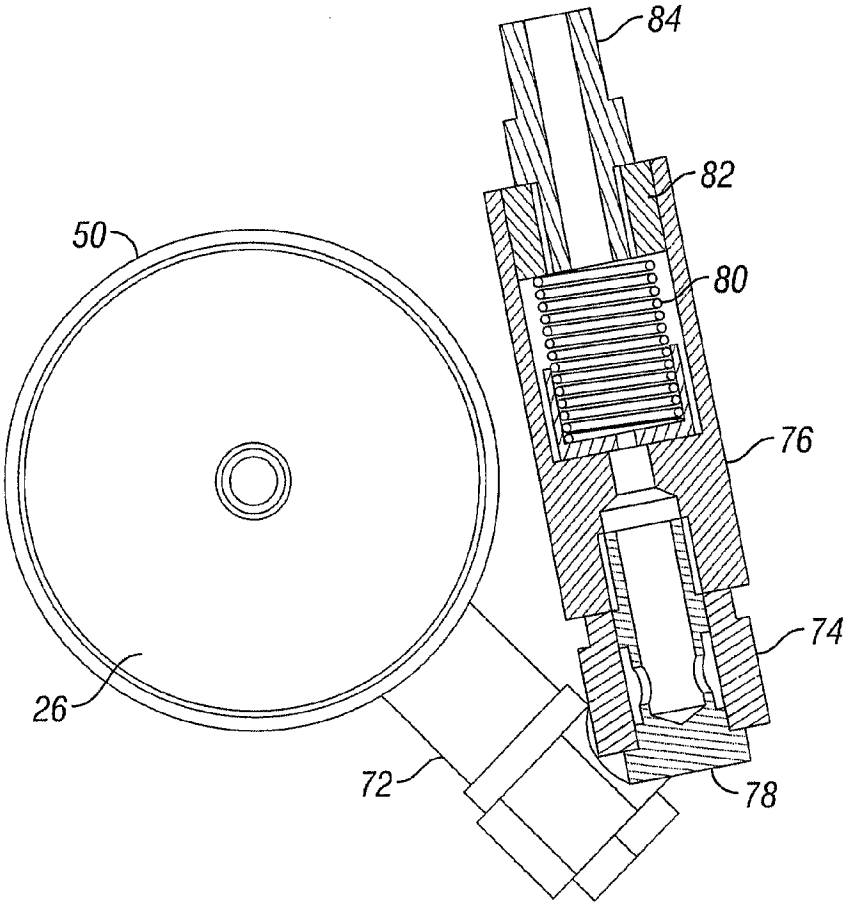
FIG. 22 is a detail view of the valve and related components in the after-fired condition.
Figure 21:
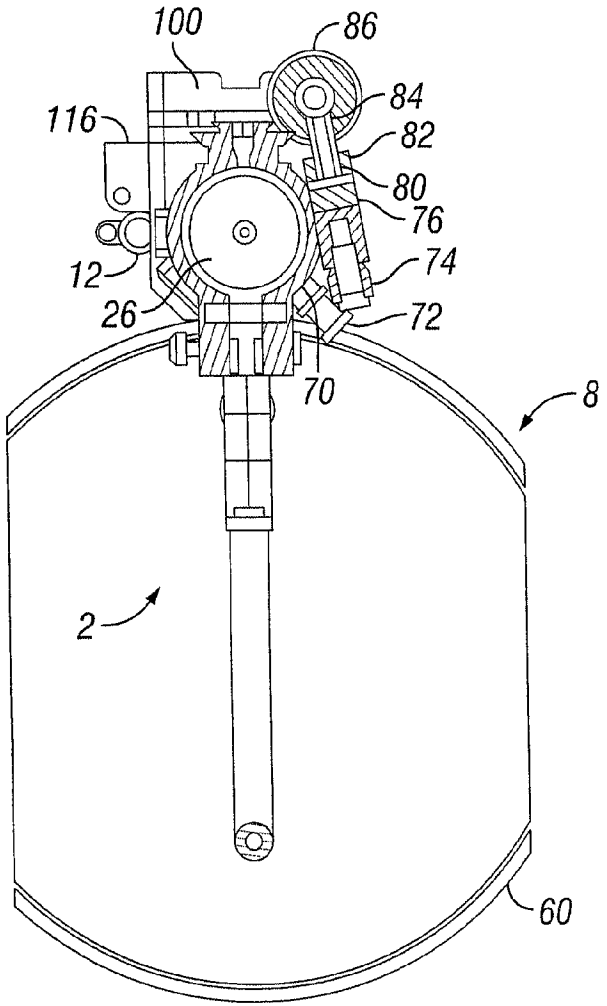
FIG. 21 is a cross-sectional view of the gun of FIG. 1 taken along line D-D of FIG. 4 shown in the after-fired condition.

A cross-sectional view of gun 1 taken along line D-D of FIG. 4 is shown in FIG. 21. At this stage, pressure is being depleted, but there is higher pressure in body 86 than valve 26. This causes check valve 80 to seat and block further flow to piston 88. It is notable, however, that an orifice exists allowing continued fluid communication between body 86 and the interior of the gun where valve 26 is located. This allows for the air pressure to bleed out from body 86 and through the gun at a controlled rate. The detailed view shown in FIG. 22 depicts check valve 80 being seated, thereby closing gap 81.

Figure 23:
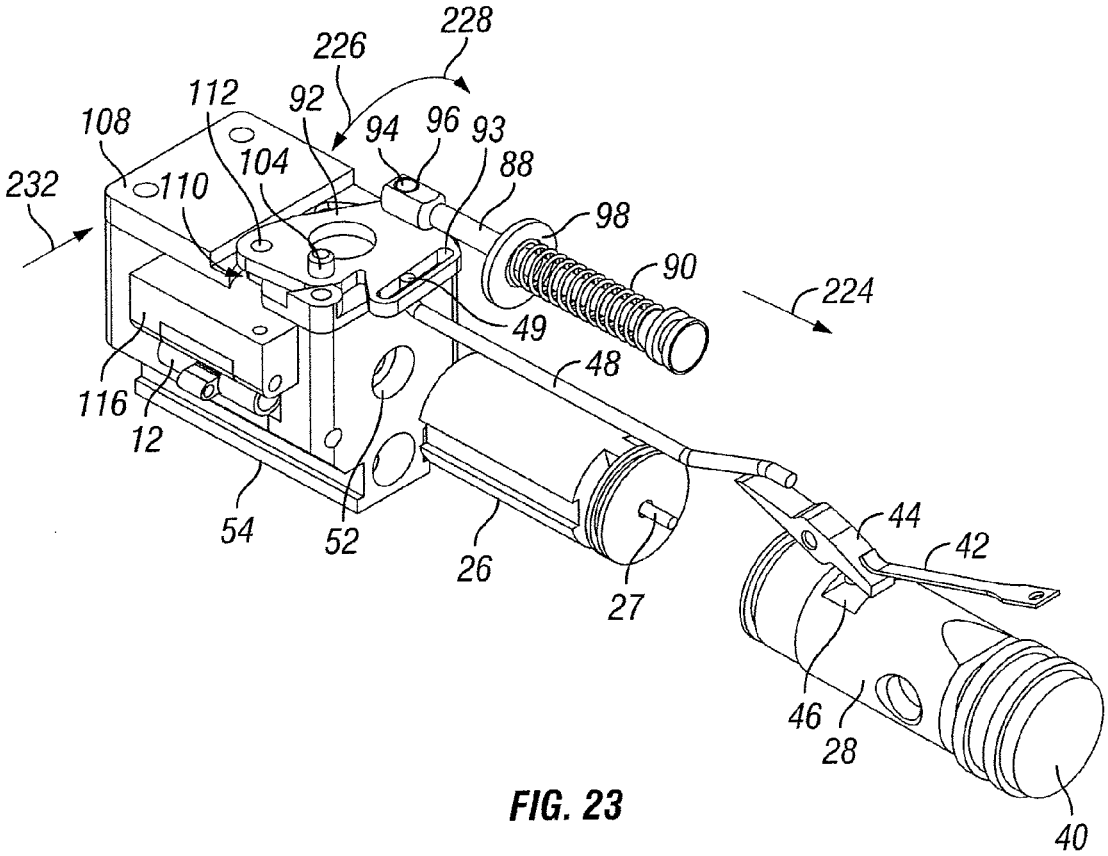
FIG. 23 is a perspective detail view of the feed mechanism, top sear trigger, top sear, spring, valve, and bolt shown in the after-fired condition.

A perspective detail view of feed mechanism 4 along with top sear trigger 48, top sear 44, spring 42, valve 26, and bolt 28, similar to FIGS. 11 and 17, is shown in FIG. 23. This view, in contrast to the priors, shows pivot arm 92 rotating in direction 228 moving pin portion 49 in slot 93. This moves sear trigger 48 to engage top sear 44 to hold bolt 28 by engaging cavity 46 until pin 112 and pivot arm 92 finish pushing slide block 116 into feeder body 54, thereby pushing link 12 into the firing position. When this feed has completed, gun 1 will be able to fire again. In particular, the movement of components shown in FIG. 23 is moving in such a way so that at the end of the stroke they are in the position shown in FIG. 11. The difference between the views in FIG. 23 and FIG. 11 is that top sear 44 will become released as trigger 48 moves across slot 93 from the position shown in FIG. 23 to the position shown in FIG. 11. At the end of the stroke a new link 12 will be in the proper firing position, as shown in the cross-sectional view of FIG. 7, so that when top sear 44 is released and bolt 28 is pushed towards stem 27, pellet 119 is in the proper firing position. This cycle may be repeated over and over again until the belt of pellets 119 are expended from all of the links, or the fluid or air supply is exhausted.

Figure 24:
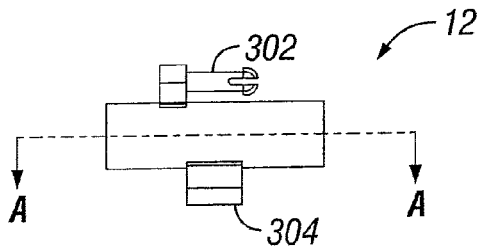
FIG. 24 is a top view of a link that holds a pellet.
Figure 25:
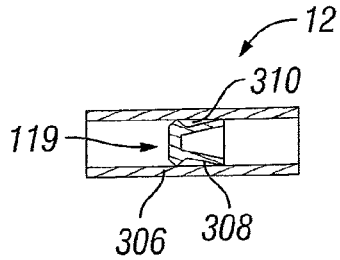
FIG. 25 is a cross-sectional view of the shell portion of the link and the pellet positioned therein.

A top view of a link 12 is shown in FIG. 24. This view shows the cartridge portion that receives pellet 119 along with a coupler 302 and a receiver 304. As shown in an illustrative embodiment, multiple links couple together in order to form the aforementioned belt. To do this, coupler 302 inserts into receiver 304 of an adjoining link 12. By repeatedly doing this with multiple links 12, the belt is formed. A cross-sectional view of a shell portion of link 12 is shown in FIG. 25. In this view, pellet 119 is positioned therein. It is appreciated that the diameter of the shell can vary slightly from smaller to larger to better hold the pellet in place. For example, pellet 119 includes a head 306 and skirt 308. It is appreciated that the diameter of the shell narrows slightly at 310 located between the head and skirt of pellet 119 to hold the pellet in place before it is fired.

Another illustrative embodiment of an automatic pellet gun is shown in FIGS. 26-44. In contrast to the prior embodiments, this embodiment uses a feed cylinder to advance links 12. This embodiment may also include a response trigger system that moves the trigger back to a ready-to-fire position once the trigger has been activated. This means each trigger pull fires one pellet, but the trigger is almost immediately ready to fire a second pellet. This allows a degree of control over the rate of fire by the user.

Figure 26:
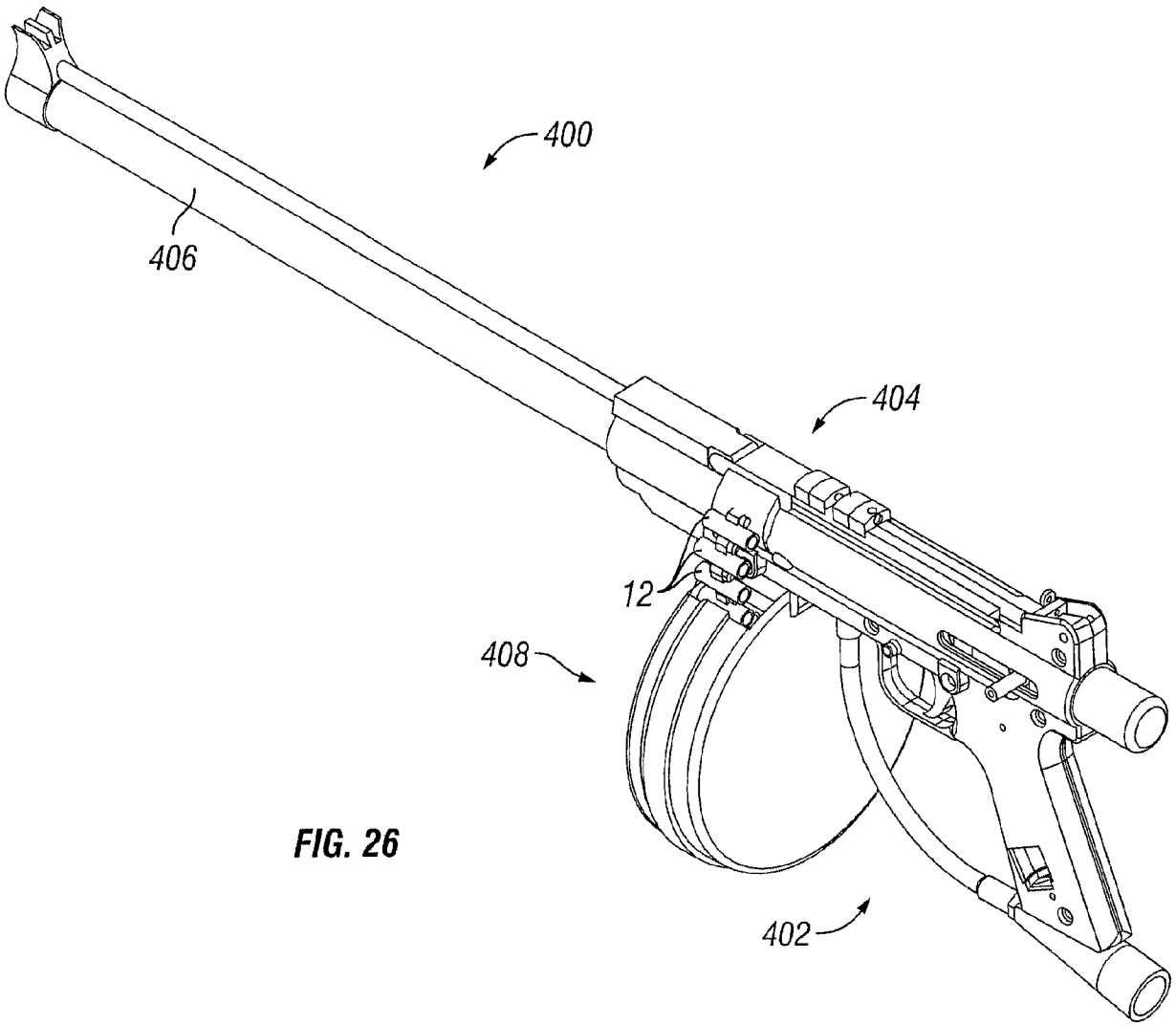
FIG. 26 is a perspective view of another illustrative embodiment of an air powered less-than-lethal pellet gun.

A perspective view of this new embodiment of an air powered automatic less-than-lethal pellet gun 400 is shown in FIG. 26. This embodiment includes the firing mechanism 402, a feeder mechanism 404, a lower barrel 406, and belt storage 408. Similar to the prior embodiment, after the pellet is shot, link 12 is moved and replaced with another link. Holder 408 like holder 8 accommodates the belt of approximately 120 links with a pellet fitted within each link. Unlike the prior embodiment, however, the trigger is forced back to the ready-to-fire position after each shot, so a person must pull the trigger each time the gun is shot. This may control the firing rate.

Figure 27:
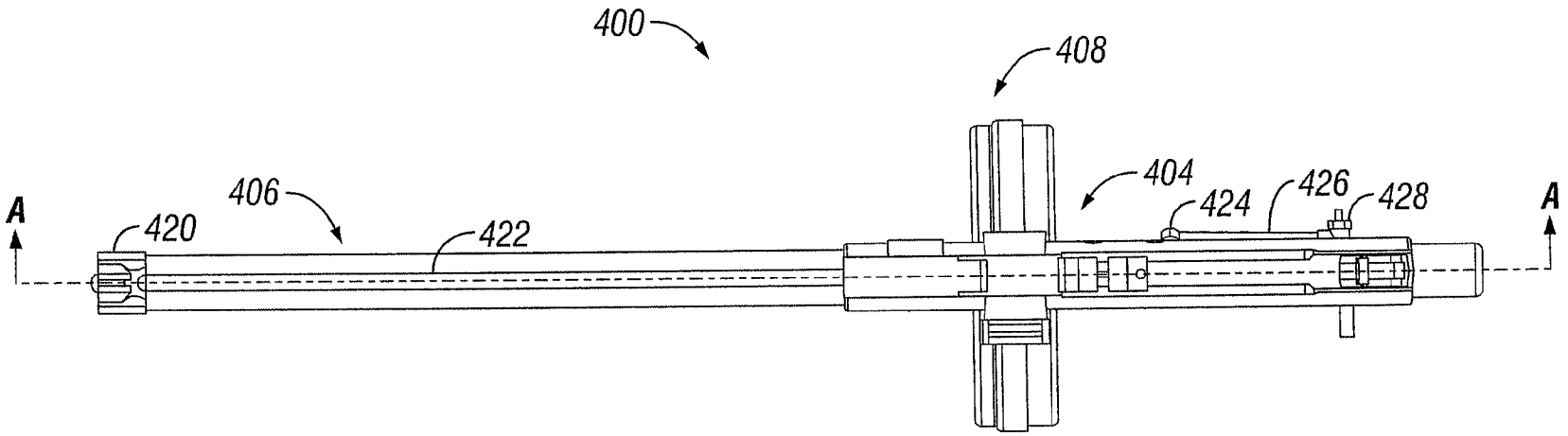
FIG. 27 is a top view of the gun of FIG. 26.
Figure 28:
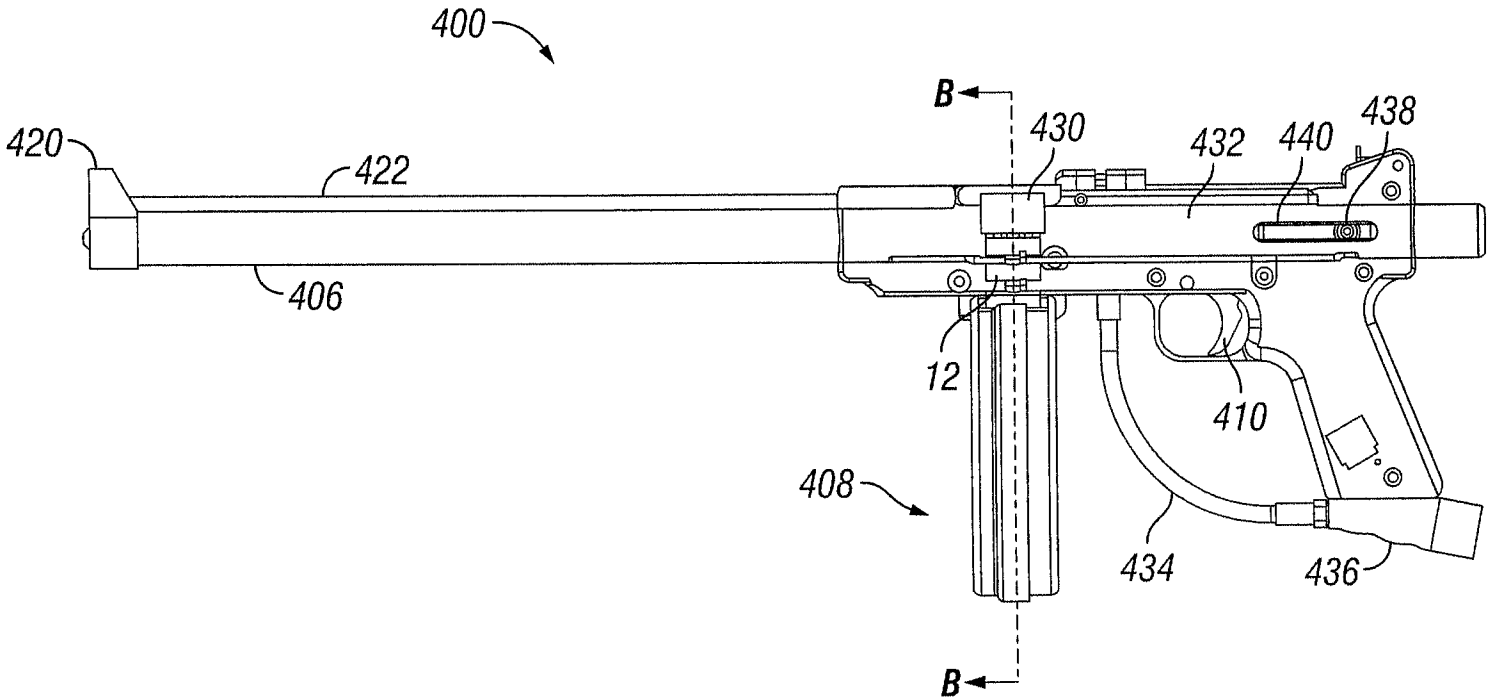
FIG. 28 is a left-side view of the gun of FIG. 26.
Figure 29:
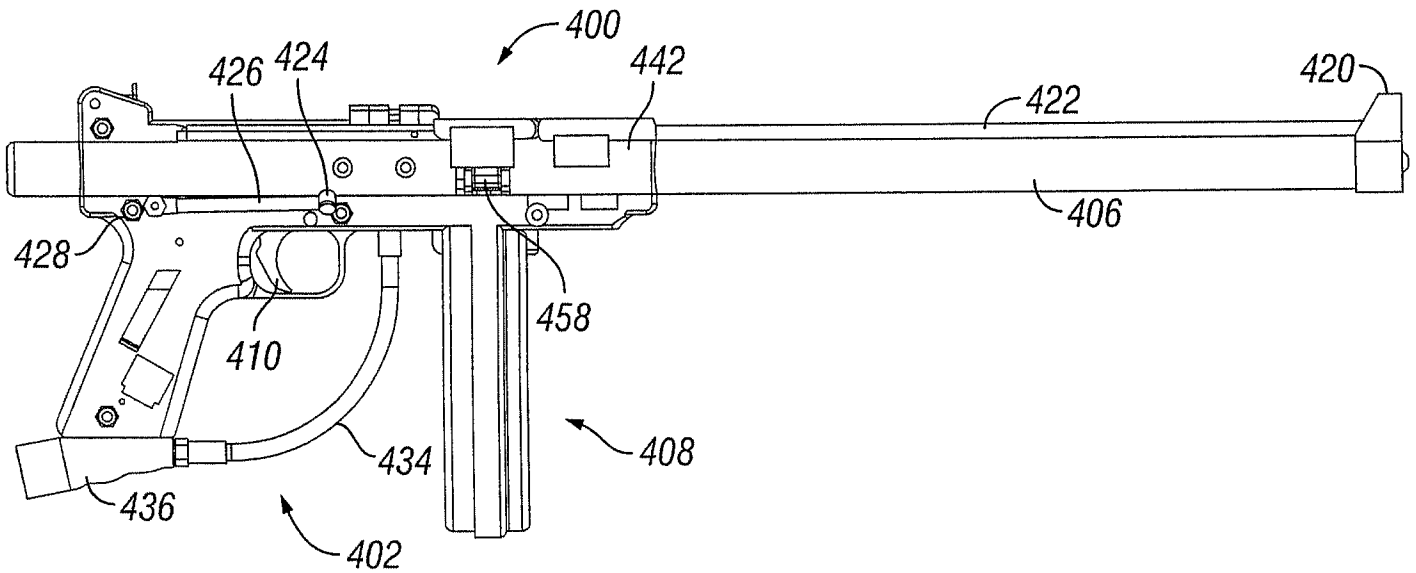
FIG. 29 is a right-side view of the gun of FIG. 26.

Top, left hand, and right hand side views of gun 400 are shown in FIGS. 27-29, respectively. The top view of FIG. 27 further shows lower barrel 406, mechanism 404 and belt storage 408. This view also shows front sight 420, barrel 422, along with fitting 424, tube 426, and flow control 428. The left side view of gun 400 shown in FIG. 28 depicts front sight 420, lower barrel 406, barrel 422, belt storage 408 along with trigger 410, belt guide 430, left receiver 432, gas line 434, and tank adaptor 436. Bolt handle 438 extends through slot 440. The right side view of gun 400 shows many of the same structures with the exception of the left receiver 432, bolt handle 438 and slot 440. Instead, the right side of gun 400 shows right receiver 442 along with fitting 424, tube 426, and fluid control 428.

Figure 30:
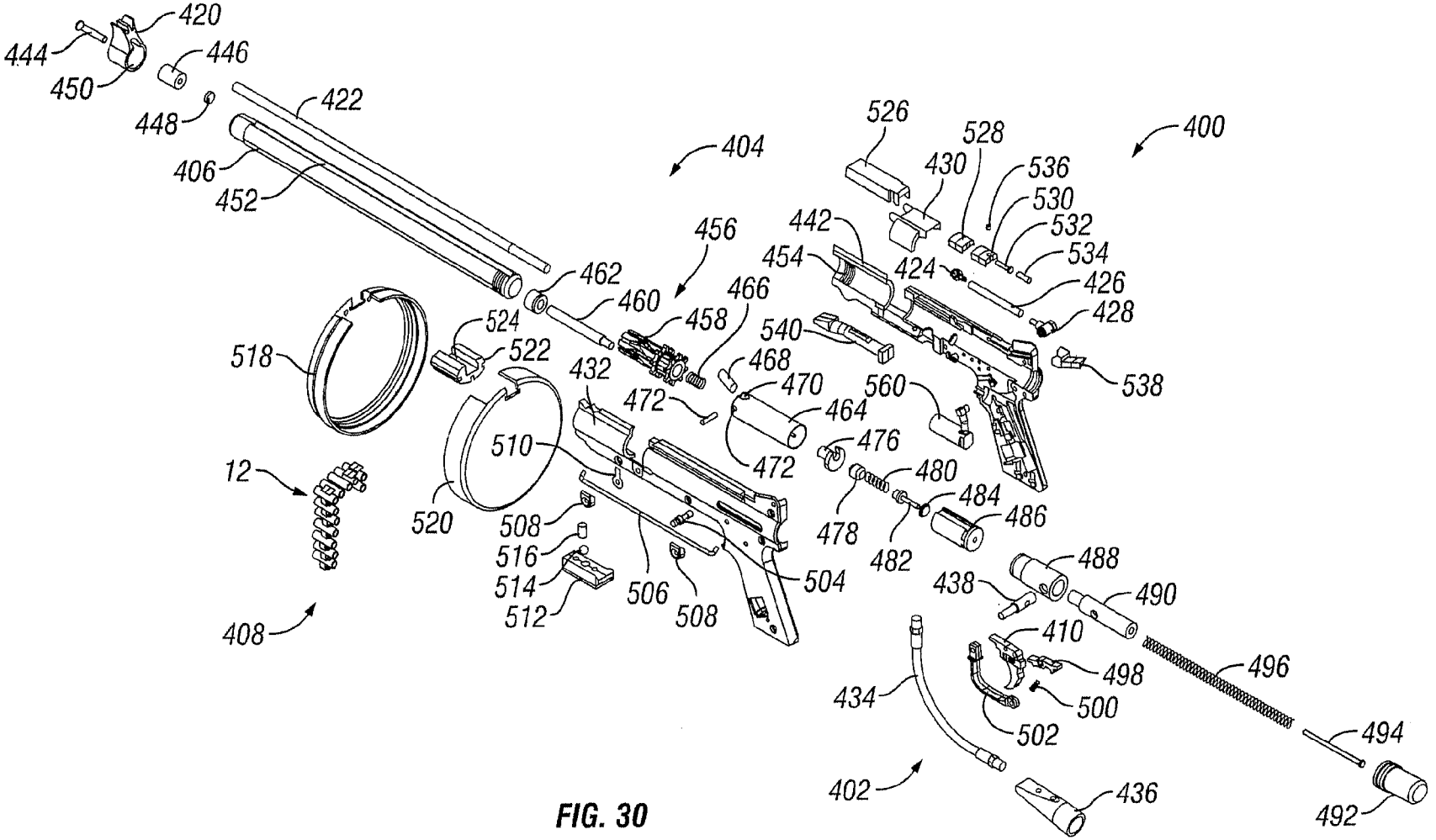
FIG. 30 is an exploded view of the gun of FIG. 26.

An exploded perspective view of gun 400 is shown in FIG. 30. A sight plug screw 444 disposes through front sight 420, rubber sight plug 446, and plug nut 448 to attach sight 420 onto lower barrel 406. It is appreciated in this illustrative embodiment that lower barrel 406 is a simulated barrel and does not eject a pellet. Rather, barrel 422 engages opening 450 in front sight 420 which is configured to eject the pellet. In the embodiment shown, barrel 422 is positioned adjacent lower barrel 406. In one illustrative embodiment, lower barrel 406 includes a groove 452 that cradles barrel 422. On the end of lower barrel 406 distal from front sight 420 is a threaded end that is illustratively configured to engage corresponding threads 454 on receivers 432 and 442, connecting barrel 406 to gun 400.

Inside receivers 432 and 442 is firing mechanism 456 that advances links 12 and propels a pellet through bore 422. Mechanism 456 illustratively includes a feed cylinder 458 that rotates about a cylinder axle 460 that fits into barrel bushing 462 at one end and power tube 464 at the other. A feed cylinder spring 466 biases against feed cylinder 458 which helps prevent excess wear against feed cylinder 458. An air transfer tube 468 illustratively fits in a groove 470 on power tube 464 to direct air against the pellet. An air transfer tube pin 472 is fitted in a corresponding opening 474 on power tube 464 to hold air transfer tube 468 in place. A power tube plug 476 inserts at the end of power tube 464 distal from air transfer tube 468. Adjacent plug 476 is valve plug 478 that is biased by valve spring 480 which also acts on valve stem 482 positioned on valve seat 484. Valve 486 is positioned adjacent valve seat 484. Rear bolt 488 includes handle 438 extending therefrom and receives the bolt plug 490. Illustratively, bolt 488 is configured to engage valve stem 482 to release fluid pressure toward air transfer tube 468 for firing the pellet and blow back against bolt 488. End cap 492 receives drive spring guide pin 494 that extends through drive spring 496 which engages and biases bolt plug 490. Spring 486 is configured to push bolt 486 against valve stem 482 when the trigger is fired to release the air. As shown, trigger 410, sear 498, sear spring 500, and trigger guard 502 release bolt 488 to begin the firing process. Gas line 434 is also shown with tank adaptor 436. Coupled to left receiver 432 is safety 504, linkage arm 506, linkage arm guides 508, and cylinder locating spring 510. As part of link storage 408, drum mount 512 attaches to receivers 432 and 442 and includes a ball bearing drum latch 514 and ball detent spring 516. Drum front 518 and back 520 receive a plurality of links 12 forming a belt that rolls up inside to dispense via feed cylinder 458. A drum base 522 includes a slot 524 that couples to drum mount 512.

This exploded view also shows back barrel clamp 526 that hingedly engages belt guide 430 so the guide can pivot with respect to gun 400 to access links 12. A latch 528 and base 530 assist in retaining and releasing belt guide 430. A latch spring 534 engages latch screw 532 to bias latch 528 against guide 430 holding guide 430 in place. Screw 532 is selectively engageable with latch 528 via spring 534 biasing against both latch 528 and set screw 536. This prevents latch 528 from sliding off guide 430. With enough force to overcome the bias of spring 536, latch 528 can be slid away from guide 430 allowing guide 430 to move. This allows access to links 12 engaged with feed cylinder 458. A rear sight 538 attaches to left and right receivers 432 and 442 to assist in aiming gun 400. A filler bar 540 adds strength to receivers 432 and 442, along with receiving attachment of drum mount 512.

Figure 31:
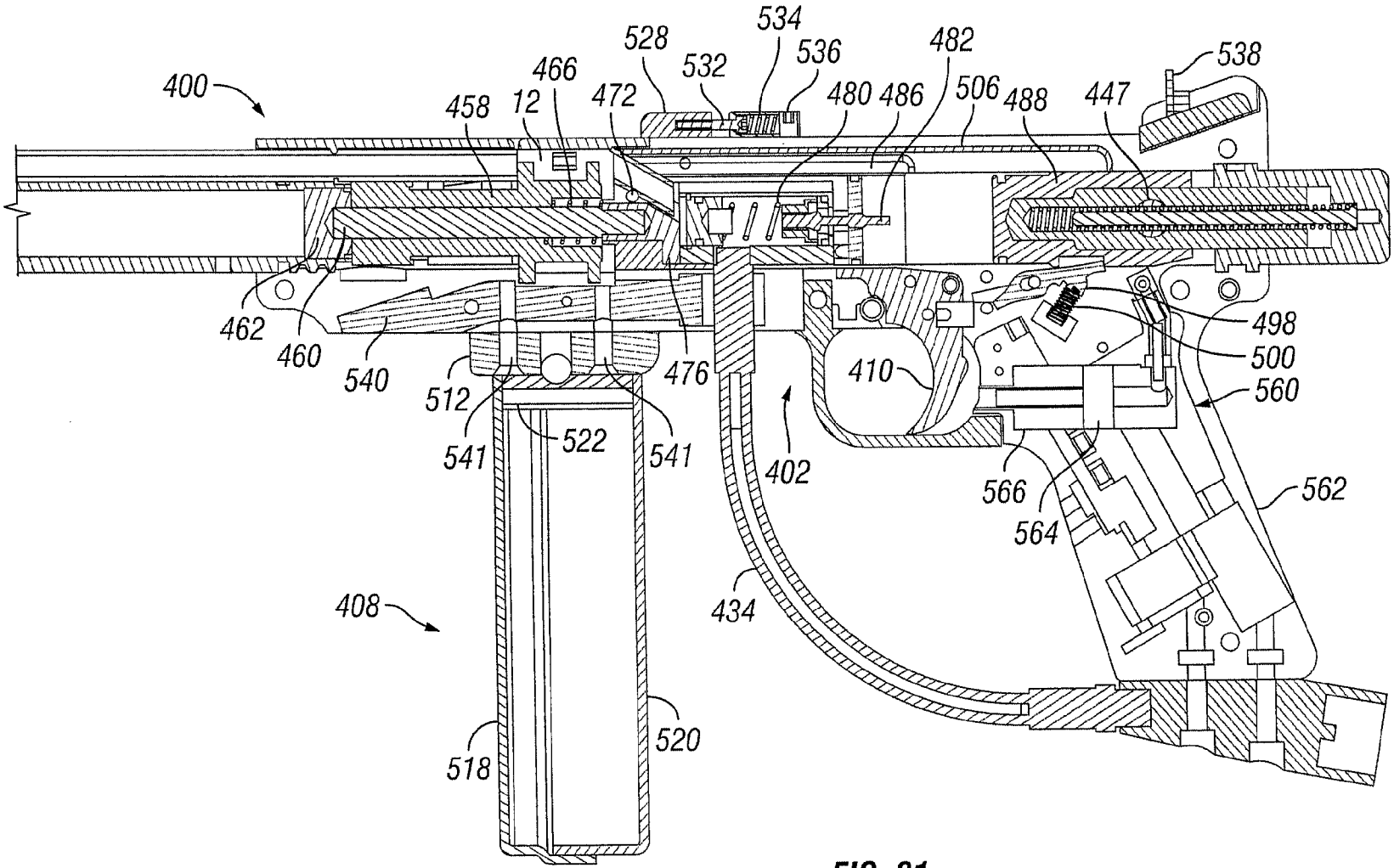
FIG. 31 is a cross-sectional view of the gun of FIG. 26 in the ready-to-fire position.

A cross-sectional view of gun 400 is shown in FIG. 31. This view shows gun 400 in a ready-to-fire position. Similar to the prior embodiment, no pellet has fired and trigger 410 has not been pulled. Bolt 488 is in the "cocked" position, meaning that it is ready to fire when trigger 410 is pulled. Like the prior embodiment, sear 498 engages both trigger 410 and notch 447 in bolt 488. This holds bolt 488 away from stem 482 in valve body 486 and against the bias of spring 480. Valve 486 is in the closed position, so no fluid from supply tube 434 enters firing mechanism 402. One link 12 is seated in feed cylinder 458. This cylinder 458 is rotatable on cylinder axle 460 which is held in place by bushing 462 and plug 476. The bias of spring 466 holds feed cylinder 458 rotatably in place. Filler bar 540 is also shown receiving fasteners 541 attaching drum mount 512 to gun 400. Covers 518 and 520 are attached to drum mount 512 via drum base 522. This view also shows latch spring screw 532 engaged with guide latch 528. Spring 534 biases screw 532 using set screw 536. Linkage arm 506 attaches to bolt 488 and engages slots in feed cylinder 458. (See, also, FIG. 34.)

To return trigger 410 to its ready-to-fire position, a response trigger system 560 is illustratively positioned just above the handle grip 562 of gun 400. Response trigger system 560 receives air from tube 434 which pushes piston 564 toward trigger 410 when a pellet is fired. Pulling the trigger biases against the piston pushing it back into cylinder 566. The fluid bleeds back through flow control 428 to valve 486, as discussed further herein. (See, also, FIG. 29.)

Figure 32:
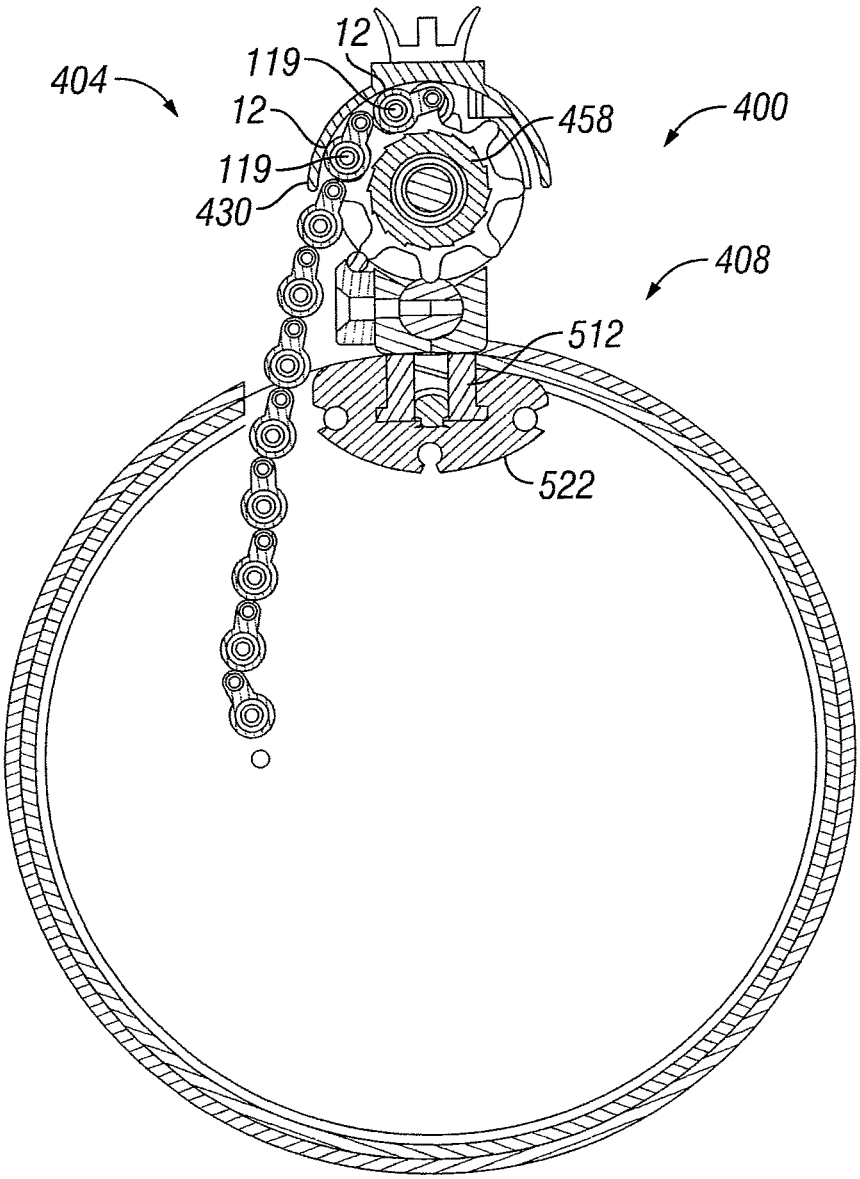
FIG. 32 is cross-sectional end view of a feed mechanism of the gun of FIG. 26.

A cross-sectional end view of feed mechanism 404 is shown in FIG. 32. In this ready-to-fire position, links 12 are located underneath belt guide 430. Each link 12 includes a pellet 119 that is shot out of barrel 422. As described further herein, feed cylinder 458 positions pellet 119 just offset of the firing position. When trigger 410 is actuated, bolt 488 through linkage arm 506 moves feed cylinder 458, thereby positioning pellet 119 in the proper firing position to allow the blast of air to eject pellet 119 from gun 400. (See, also, FIG. 34.) This view also shows how assembly 408 attaches to gun 400. The engagement between drum base 522 and mount 512 is illustratively slip fit. Detent ball 514 is biased by spring 516 to engage a detent 543 in slot 524 to help keep assembly 408 in place. (See, also, FIG. 35.)

Figure 33A:
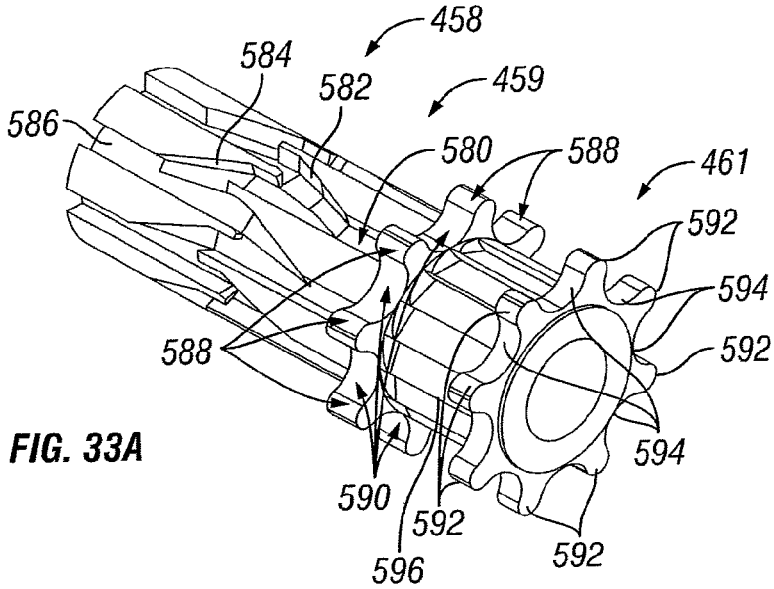
FIGS. 33*a-c* show perspective, end cross-sectional, and side views of a feeder cylinder.
Figure 33B:
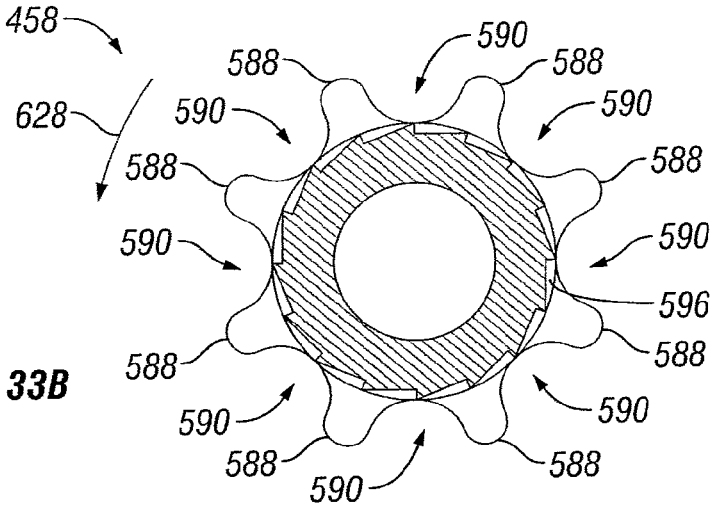
Figure 33C:
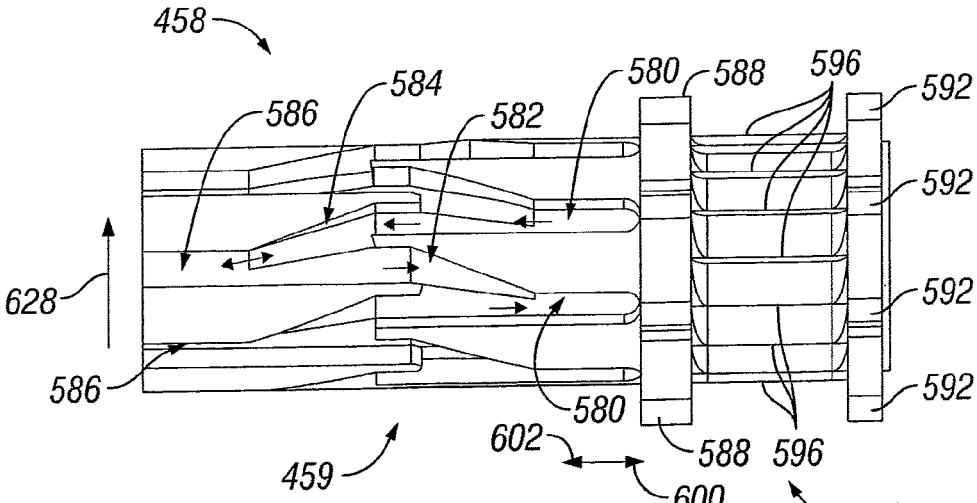

Perspective end cross-sectional and side views of feed cylinder 458 are shown in FIGS. 33*a-c* respectively. Feed cylinder 458 includes a slot portion 459 and a gear portion 461. Slot portion 459 includes a first slot region 580, second slot region 586, first angled slot region 584, and second slot region 582. Slot regions 580, 582, 584, and 586 are configured so that linear travel of linkage arm 506 translates into rotational movement of feed cylinder 458. When linkage arm 506 travels in slot regions 580 and 586, the feed cylinder 458 does not rotate. As shown in FIG. 33*c*, slot region 580 and 586 are also offset from each other. When linkage arm 506 moves in direction 602, it engages first angled region 584. Traveling along this angled area towards slot region 586 forces feed cylinder 458 to rotate in direction 628, since feed cylinder 458 is rotatably coupled to axle 460. The offset between slot regions 580 and 586 is accounted for because linkage arm 506 will rotate feed cylinder 458 until it engages second angled region 582. In an illustrative embodiment feed cylinder 458 rotates about 22.5 degrees at a time. When linkage arm 506 retracts in direction 600, it engages second angled region 582. To get linkage arm 506 to enter a new first slot region 580, feed cylinder 458 rotates again illustratively another 22.5 degrees.

Feed cylinder 458 rotates link 12 by coupling link 12 to gear portion 461. In an illustrative embodiment, gear portion 461 includes front gear lobes 588 separated by front channels 590. There are also rearward lobes 592 separating rear channels 594. A link 12 sits in channels 590 and 594. As feed cylinder 458 rotates, so too does coupled links 12. In addition, the lobes are configured such that as feed cylinder 458 continues to rotate, lobes 588 and 592 engage additional links 12. Continued rotation of feed cylinder 458 continually engages more links 12. Gear portion 461 also includes detent edges 596. This is readily shown in FIG. 33*b*. Spring 510 is configured to engage detent edge 596 to prevent feed cylinder 458 from freely rotating in a direction opposite of direction 628.

Figure 34:
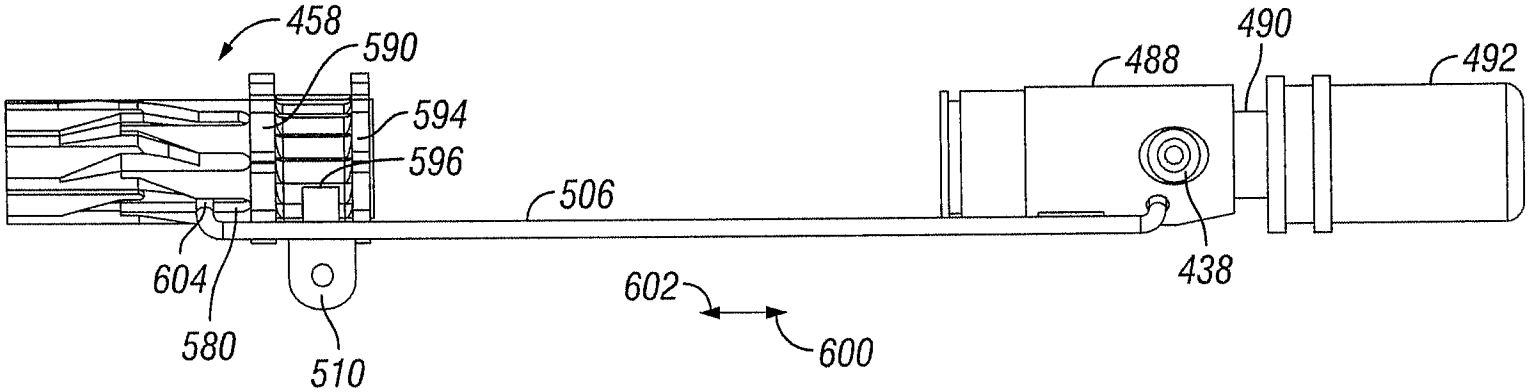
FIG. 34 is an isolated top view of the feed cylinder, linkage arm, and bolt from the gun shown in FIG. 26.

An isolated top view of feed cylinder 458, linkage arm 506, and bolt 488 is shown in FIG. 34. With bolt 488 in the cocked position, linkage arm 506 is drawn back in direction 600 so that the distal end 604 is located in slot region 580 of feed cylinder 458. As previously discussed, when in this position, link 12 (not shown in this view) fits in channels 590 and 594 offset from the fluid supply. Spring 510 abuts against detent edge 596 to prevent feed cylinder 458 from freely rotating in a direction opposite of direction 628.

Figure 35:
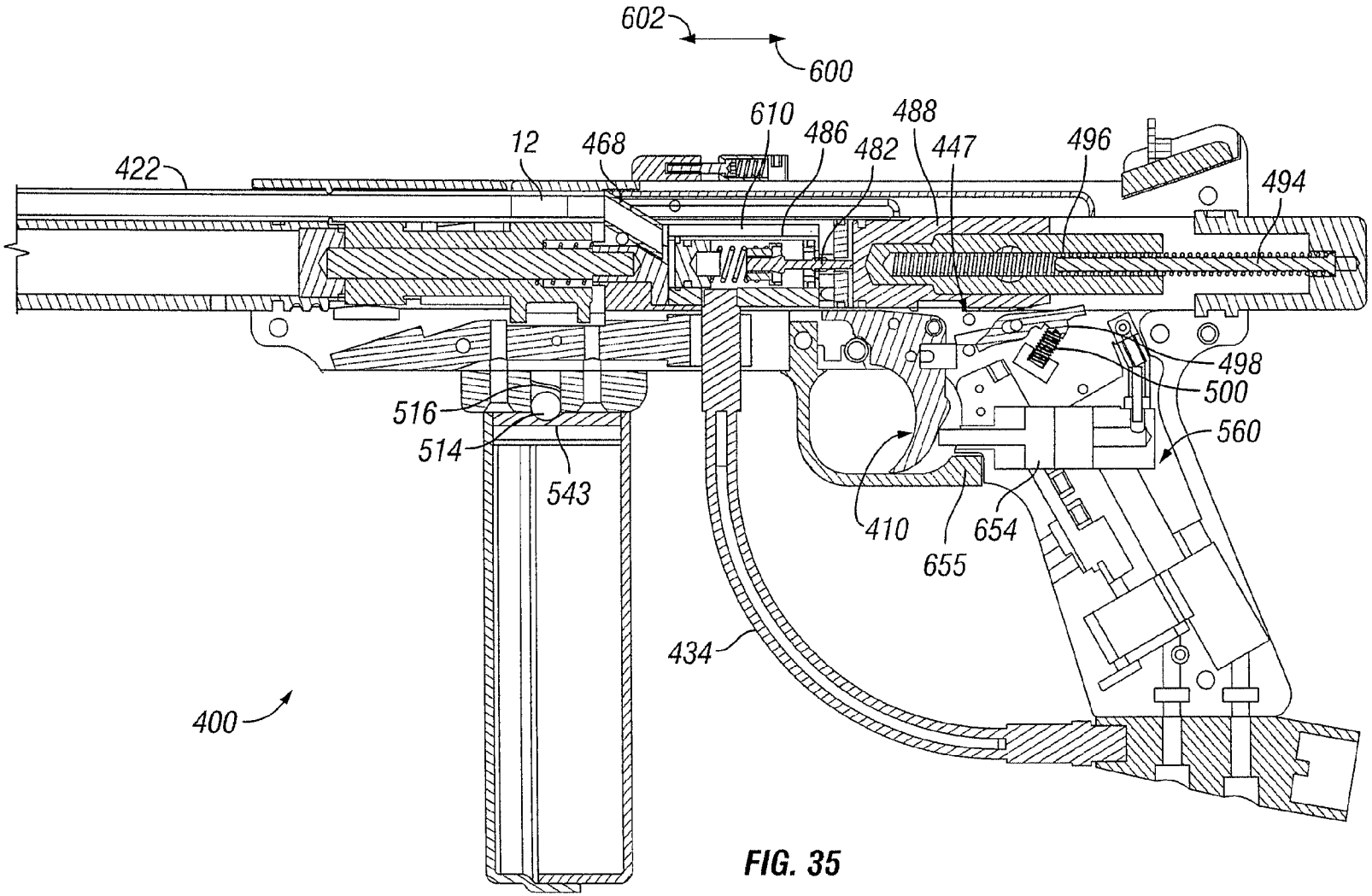
FIG. 35 is another side cross-sectional view of the gun of FIG. 26 shown in the firing condition.
Figure 36:
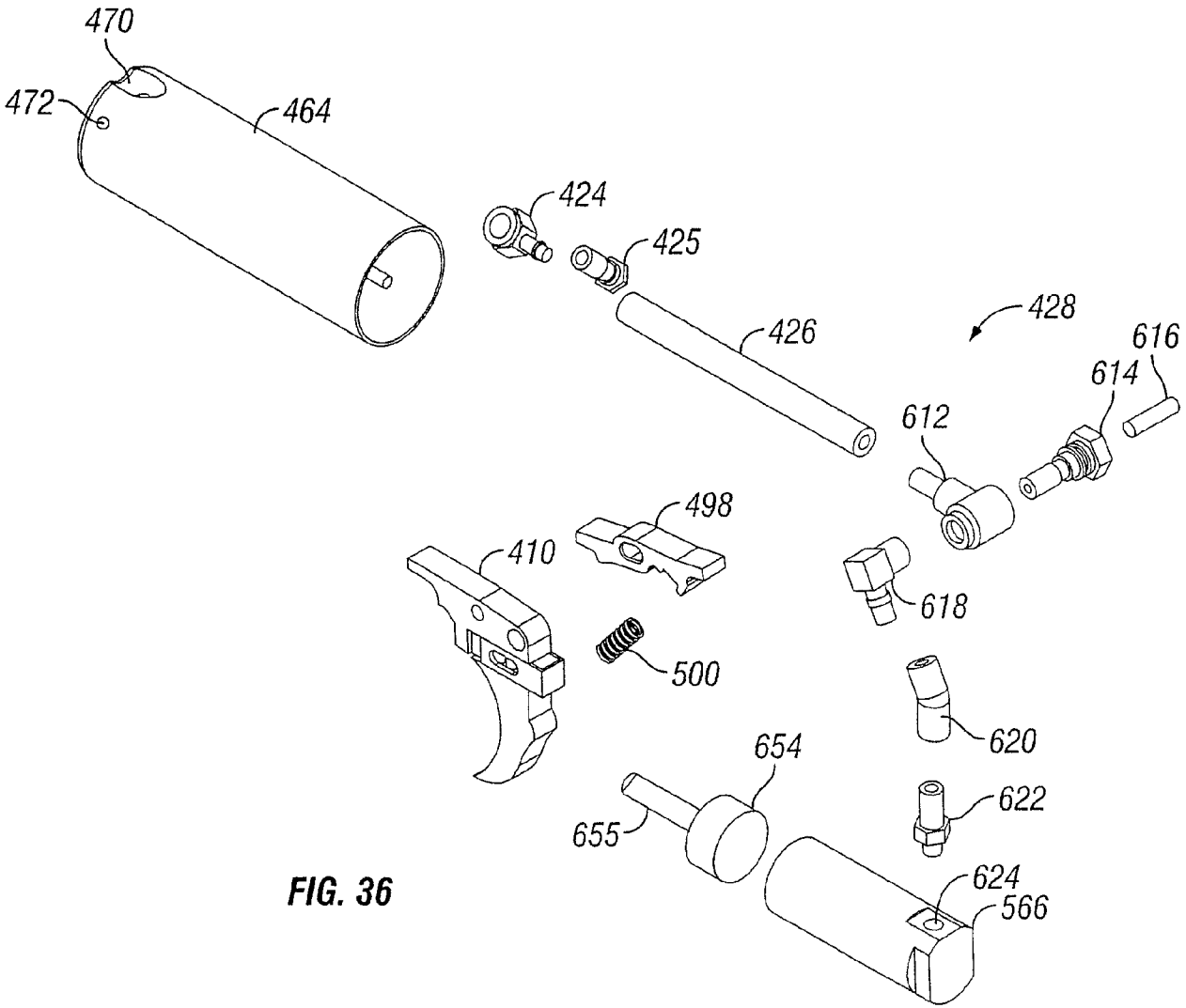
FIG. 36 is an exploded view of a response trigger system.

Another side cross-sectional view of gun 400 is shown in FIG. 35. This view is similar to the view in FIG. 31 except that now gun 400 is being fired. As shown in this view, trigger 410 is actuated which releases sear 498 from notch 447 in bolt 488. The bias from spring 496 disposed about spring guide 494 pushes against bolt 488 rapidly moving the same in direction 602 until it engages and pushes stem 482 in direction 602. This releases fluid from tube 434 into valve 486. The fluid travels in direction 602 through air transfer tube 468 whose distal opening faces link 12, ejecting a pellet therefrom and out barrel 422. At this time, fluid is also supplied back through channel 610 of valve 486 to blow back bolt 488 in direction 600 against the bias of spring 496, thereby starting the process of resetting a firing mechanism to the ready-to-fire position.

Figure 37:
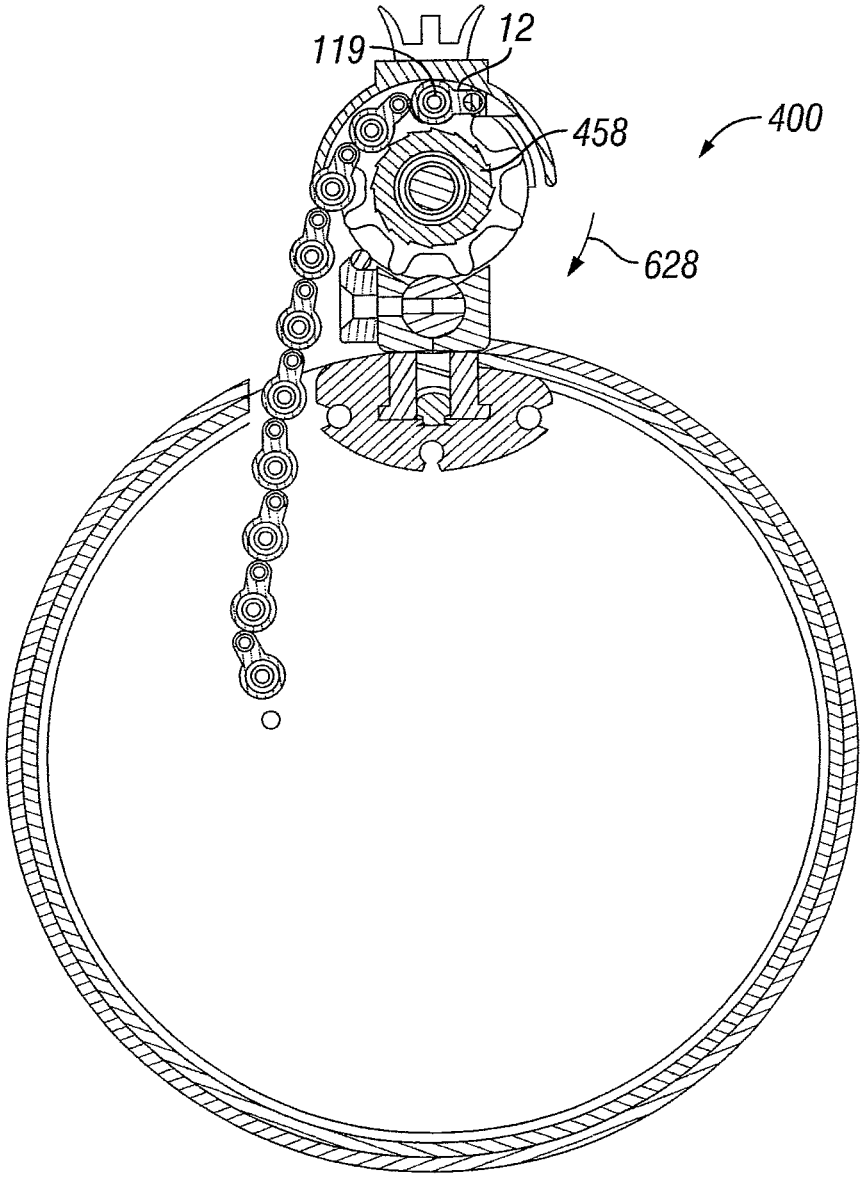
FIG. 37 is a cross-sectional end view of the feed mechanism on the gun of FIG. 26 shown in the firing condition.

Fluid is also supplied to response trigger system 560 via fittings 424 and 425, tube 426, flow control assembly 428 which includes air inlet 612, flow control metering housing 614, and metering screw 616. Assembly 428 is in fluid communication with fitting 618 which itself is in communication with hose 620 and straight fitting 622. Fitting 622 fits into opening 624 of cylinder 566 which receives piston 654 with piston rod 655 extending therefrom. (See also FIG. 36.) Referring back to FIG. 35, as fluid reaches piston 654, it pushes rod 655 in direction 602 and against trigger 410 pushing the same back to the ready-to-fire position. A cross-sectional view of gun 400 in FIG. 37 shows link 12 and pellet 119 centrally positioned with respect to air transfer tube 468. (See also FIG. 35.) Feed cylinder 458 rotates in direction 628. In this illustrative embodiment, feed cylinder 458 has moved link 12 approximately 22.5 degrees between the views shown in FIGS. 32 and 37.

Figure 38:
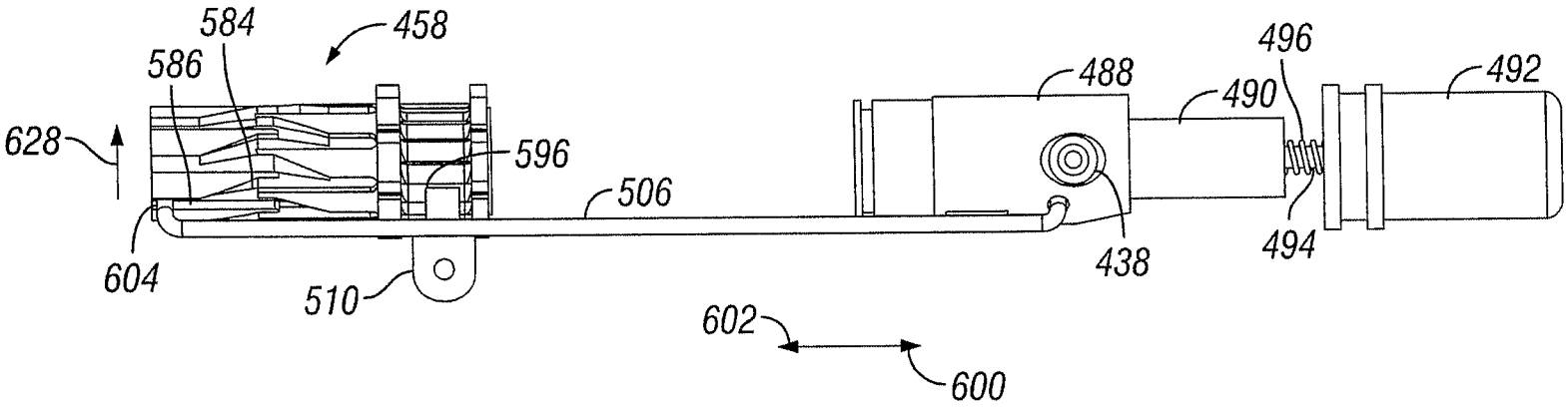
FIG. 38 is an isolated detail view of the feed cylinder, linkage arm, and bolt of the gun of FIG. 26.

The isolated detail view of feed cylinder 458, linkage arm 506, and bolt 488 is shown in FIG. 38. This view also includes cap 492 and spring 496 wrapped around spring guide pin 494 that biases against bolt plug 490. This view is contrasted from the view of FIG. 34 where bolt 488 is closer to cap 492 which causes linkage arm 506 to be positioned in portion 580 of feed cylinder 458. In this present view, the bias of spring 496 pushes bolt 488 in direction 602 which pushes the terminal portion 604 of linkage arm 506 to slot region 586 of a feed cylinder 458. Because the linear movement of terminal portion 604 has to cross first angled region 584 in order to get to region 586, feed cylinder 458 is forced to rotate around cylinder axle 460 approximately 22.5 degrees to position link 12 in the firing position. In other words, the linear movement of linkage arm 506 caused by bolt 488 causes feed cylinder 458 to rotate in direction 628. Spring 510 engages edge 596 to prevent cylinder 458 from freely rotating in a direction opposite of direction 628. At this point, the air that was released from tube 434 moves through air transfer tube 468 forcing the pellet out of link 12 and firing it through barrel 422 and out gun 400.

Figure 39:
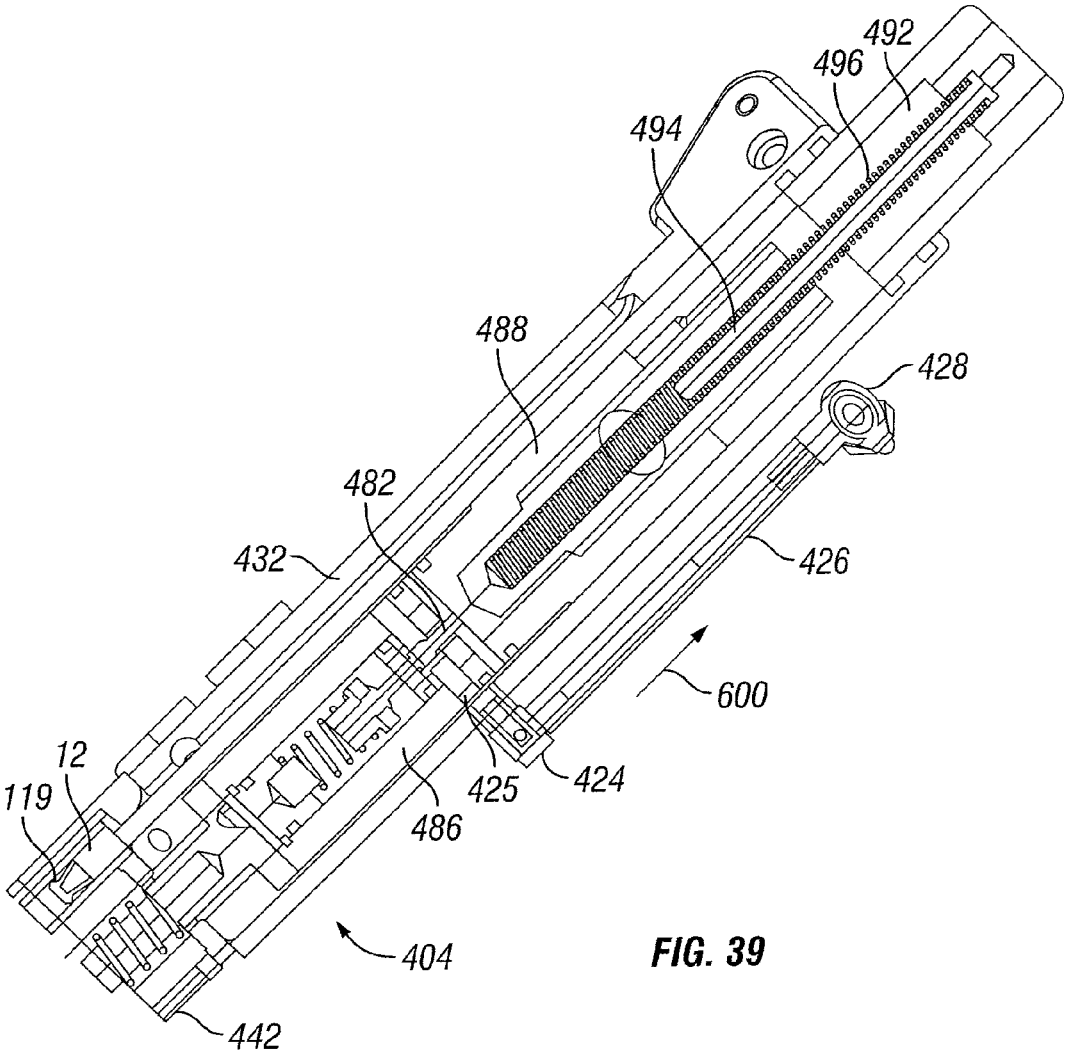
FIG. 39 is an underside sectional view of a portion of the firing mechanism of the gun shown in FIG. 26.

In addition to the air supply firing the pellet, air also transfers from valve 486 to actuate response trigger system 560 which pushes trigger 410 back to the ready-to-fire position. The underside sectional view of a portion of the firing mechanism 404 is shown in FIG. 39. This view also shows fitting 424 in fluid engagement with valve 486. A gap 425 receives air from the fluid source when bolt 488 moves stem 482. Gap 425 is in fluid communication with fitting 424 which receives the air. Once air enters fitting 424, it travels through tube 426 and into flow control valve 428 in direction 600. Fitting 618 attaches to flow control body 612 and is in fluid communication therewith so the fluid that started out in valve 486 is now traveling through tube 620 and fitting 622 and into cylinder 566. This air pressure accumulating in cylinder 566 pushes piston 654 so piston rod 655 engages trigger 410 pushing the same back to the ready-to-fire position.

Figure 40:
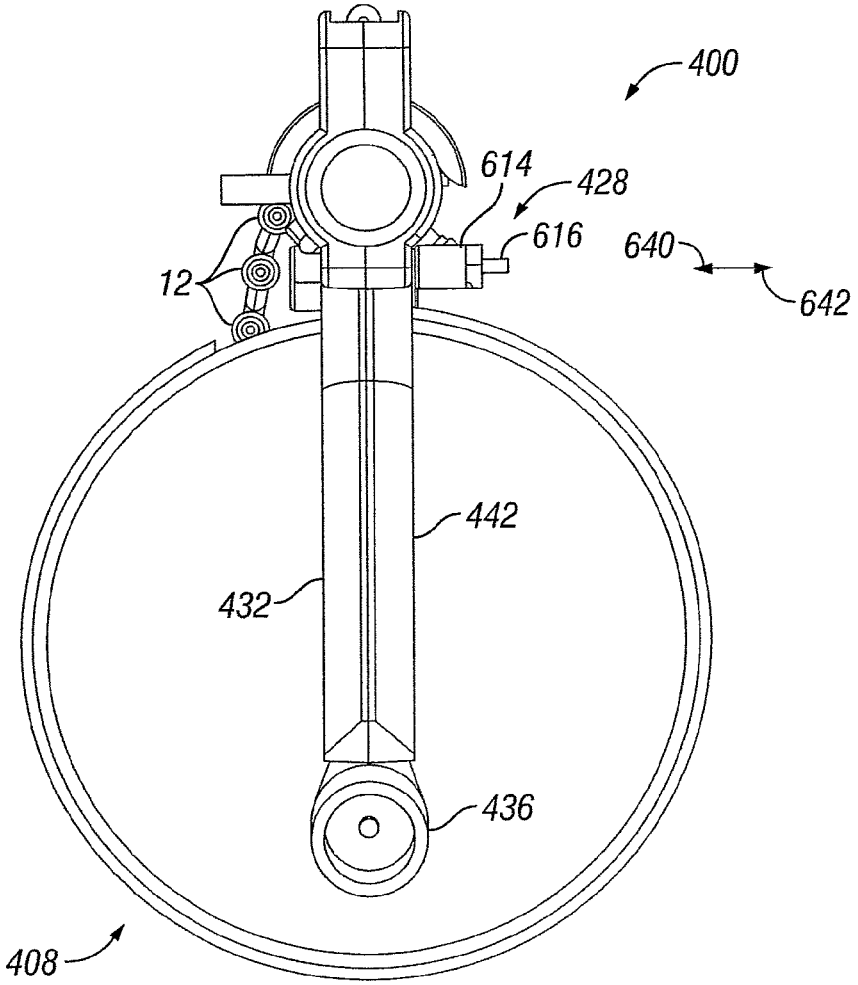
FIG. 40 is a front view of the gun of FIG. 26.
Figure 41A:
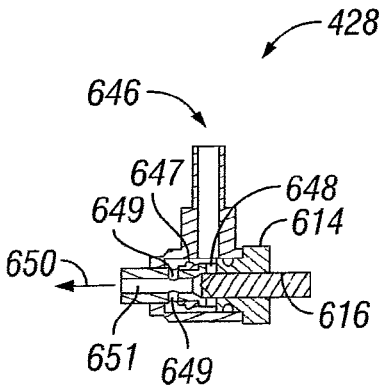
FIGS. 41*a* and *b* are end cross-sectional views of a flow control assembly.
Figure 41B:
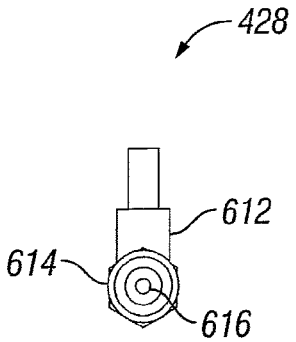

In an illustrative embodiment, the response action of response trigger system 560 is adjustable, so the firing rate can be changed. As shown in FIG. 40, flow control valve 428 includes a metering screw 616 that can be rotated on the side of gun 400. Screw 616 is movable inward in direction 640 to reduce the firing rate. Conversely, screw 616 is also movable outward in direction 642 to increase the firing rate. This is accomplished using flow control assembly 428 as shown in FIGS. 41*a* and *b*. As shown in FIG. 41*a*, air enters inlet 646 of flow control body 612 and into passage 647 around housing 614. The air enters passage 651 of housing 614 via cross-passages 649. Air travels in direction 650 and into response trigger system 560 to push trigger 410 back to the ready-to-fire-position.

After trigger 410 is moved, the air in response trigger system 560 is exhausted. The air enters a passage 648 and exits out of flow control body 612 to dissipate in the firing mechanism of gun 400. Air flow metering is controlled by metering screw 616 of housing 614. Passage 648 can be partially or wholly blocked by metering screw 616, thereby controlling the rate of release of the air. In other words, metering screw 616 selectively limits the ability of air to flow out of response trigger system 560 which controls the firing rate of gun 400, as previously discussed. (See, also, FIG. 41.)

In sum, when trigger 418 is actuated, fluid from tube 434 enters valve 486 which distributes the air through air transfer tube 486, back against bolt 488, and also out to response trigger system 560. So while the gun is firing the pellet, the same air supply is resetting the gun by advancing link 12 and a returning trigger 410 to the ready-to-fire position.

Figure 42:
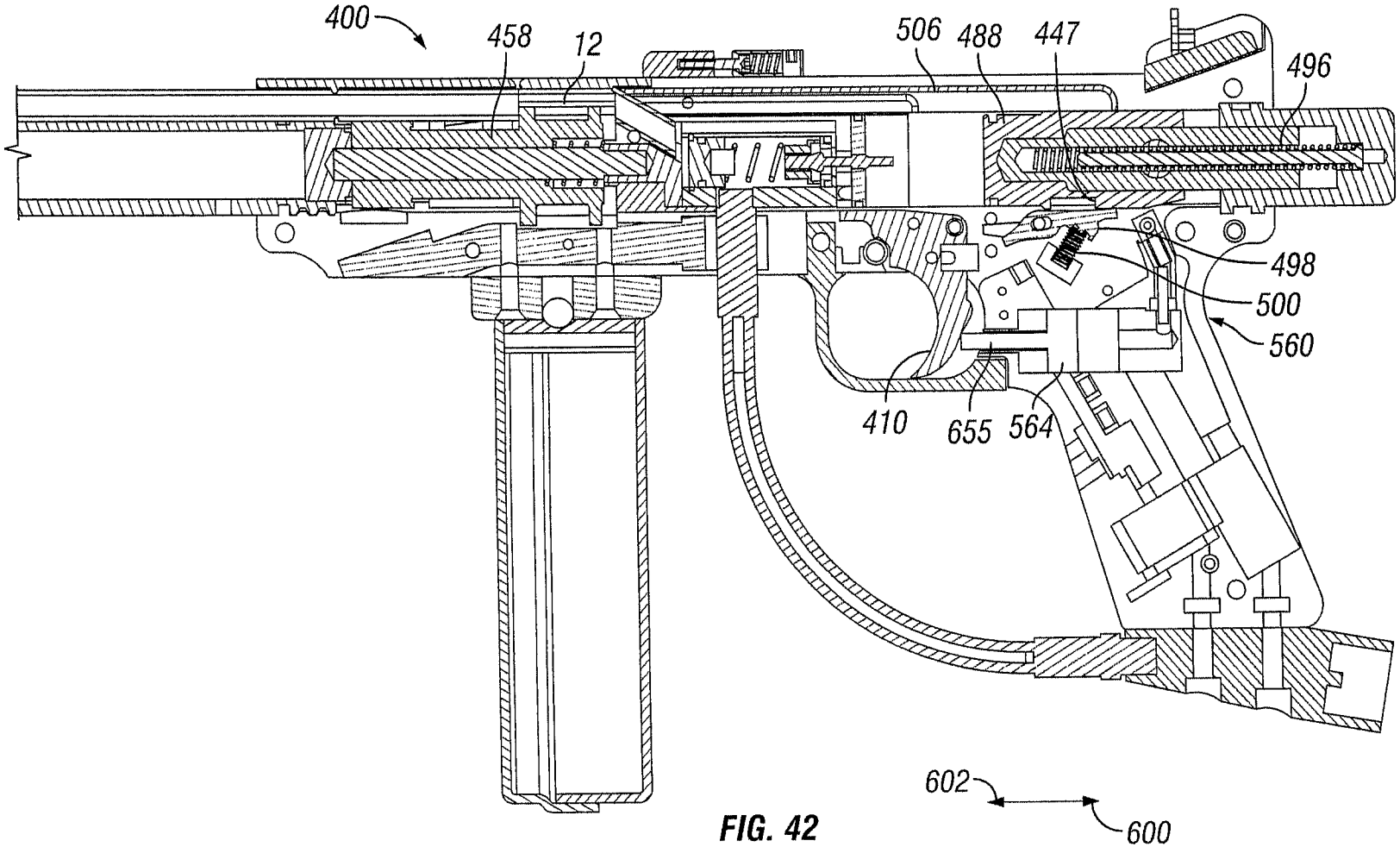
FIG. 42 is a cross-sectional side view of the gun of FIG. 26 shown in the returning to ready-to-fire condition.

Another cross-sectional side view of gun 400 is shown in FIG. 42. This view differs from FIGS. 31 and 35 in that the gun is in its returning to ready-to-fire configuration. Here bolt 488 is blown back in direction 600 to reset the positioning of link 12. Bolt 488 has not yet moved back far enough against the bias of spring 496 for sear 498 to engage notch 447. Linkage arm 506 is, nevertheless, being drawn in direction 600 as well, which is also causing feed cylinder 458 to rotate. (See also FIG. 44.) As previously discussed, fluid is also entering system 560 pushing piston 564 and piston rod 655 in direction 602, pushing trigger 410 in direction 602 toward its ready-to-fire position. It is appreciated that all of this happens relatively rapidly, so trigger 410 is ready to fire another pellet. Once the trigger is back in the ready-to-fire position, it can be actuated again. This process can repeat itself over and over again to allow a rapid succession of shots.

Figure 43:
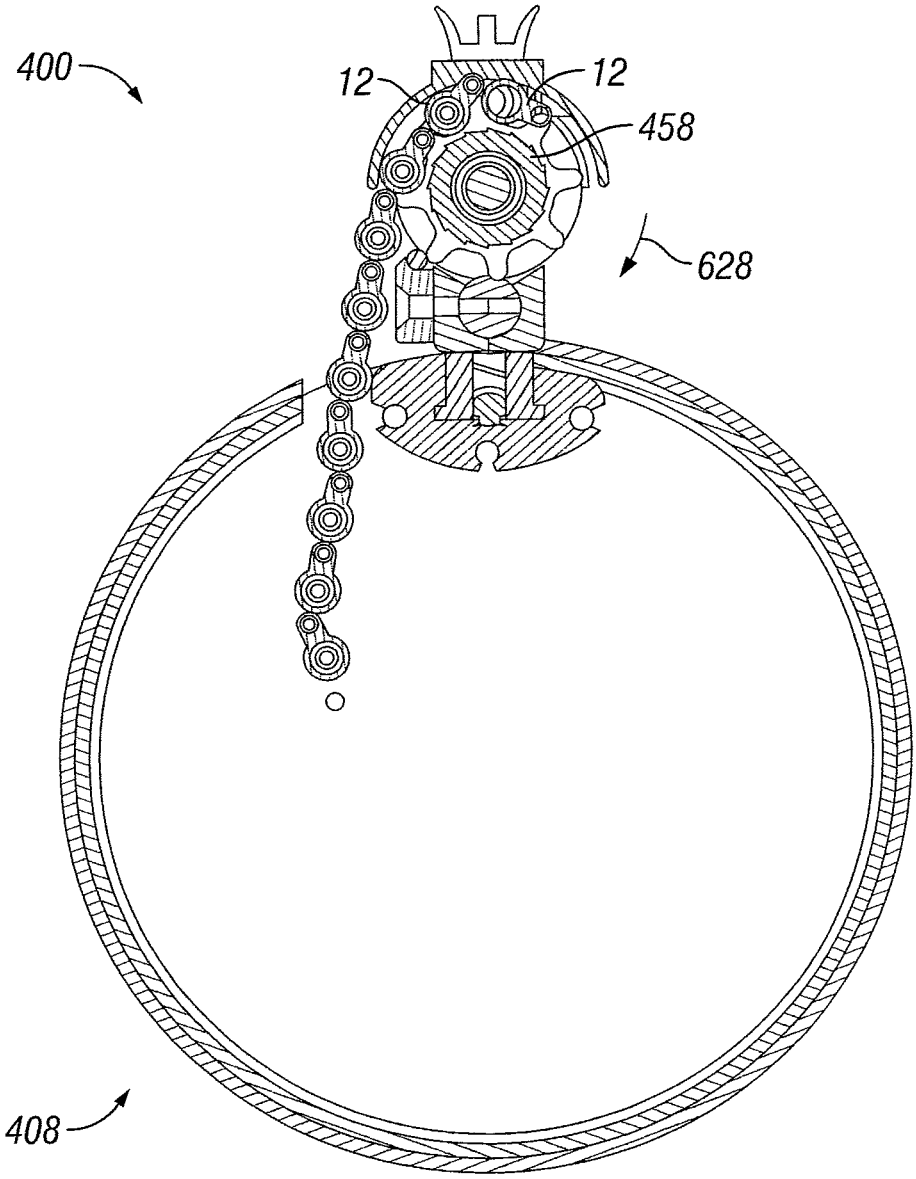
FIG. 43 is an end cross-sectional view of the gun of FIG. 26 shown in the returning to ready-to-fire condition.

The end cross-sectional view of gun 400 is shown in FIG. 43. In contrast to FIGS. 32 and 37, FIG. 43 shows feed cylinder 458 rotating in direction 628 causing link 12, that just had a pellet ejected therefrom, to move out of the way also in direction 628. A subsequent link 12 with a pellet located therein moves towards the firing position, as shown in FIG. 32.

Figure 44:
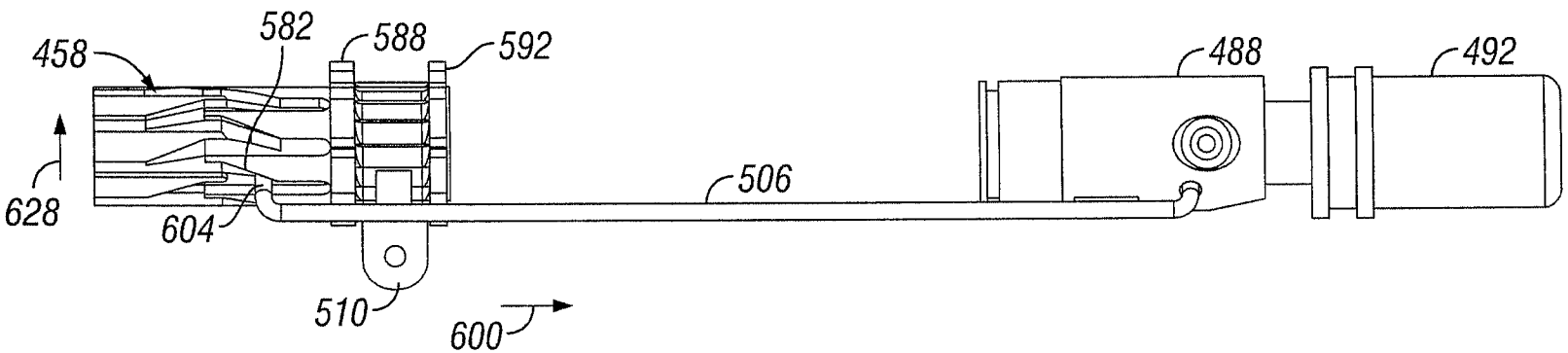
FIG. 44 is a detail view of the feed cylinder, linkage arm, bolt, and cap from the gun of FIG. 26 shown in the returning to ready-to-fire condition.

The detail view of feed cylinder 458, linkage arm 506 and bolt 488 adjacent cap 492 is shown in FIG. 44. This view differs from FIGS. 34 and 38 in that the terminal end 604 is being drawn back in direction 600 where it engages the second angled region 582 causing feed cylinder 458 to rotate in direction 628. This rotation also rotates lobes 588 and 592 which is what rotates link 12, Spring 510 is also shown preventing free rotation of feed cylinder 458. The linear travel demonstrates how that can be converted into rotational movement of feed cylinder 458.

Although the present disclosure has been described with reference to particular means, materials and embodiments, from the foregoing description one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A method of firing a less-than-lethal pellet gun comprising the steps of:

providing a plurality of links each holding a pellet configured to be fired through a barrel of the pellet gun;

providing a feed cylinder to advance the links to a firing position and ejecting each link after its pellet has been fired;

activating a trigger which causes a bolt attached to a linkage arm to linearly move, wherein the feed cylinder includes a slot portion and a gear portion, wherein the slot portion includes a first slot region, a second slot region, a first angled slot region, and a second angled slot region, wherein a portion of the linkage arm engages the slot portion of the feed cylinder such that the linear movement of the linkage arm causes the portion of the linkage arm to travel along the first and second slot and first and second angled slot regions rotating the feed cylinder, and wherein at least one of the plurality of links engages a portion of the gear portion of the feed cylinder;

rotating the feed cylinder to move one of the plurality of links holding the pellet to a firing position;

releasing a sear from a notch in the bolt;

biasing against the bolt from a spring to move the bolt until it engages a stem which releases fluid from a container into a valve and toward the link;

firing the pellet from the release of fluid through the valve;

supplying fluid back through a portion of the valve to move the bolt against the bias of the spring to reset the gun to a ready-to-fire position;

moving the linkage arm through the second angled slot and first slot portions after the pellet is fired to eject the one link the pellet was fired from and replace with a second link;

engaging both trigger and notch in the bolt by the sear after the pellet has fired to hold the bolt away from the stem which closes the valve to prepare the gun to fire again.

2. The method of firing the less-than-lethal pellet gun of claim 1, further comprising the steps of:

offsetting the first and second slot regions from each other, wherein the feed cylinder does not rotate as the linkage arm travels in slot regions, wherein as the portion of the linkage arm is engageable with the first angled portion causing the feed cylinder to rotate in one direction, and when the portion of the linkage arm moves in another direction it engages the second angled portion.

3. The method of firing the less-than-lethal pellet gun of claim 1, wherein the gear portion includes front lobes separated by front channels and rear lobes separated by rear channels, wherein one of the plurality of links sits in the front and rear channels such that as the feed cylinder rotates, so too does the plurality of links.

4. The method of firing the less-than-lethal pellet gun of claim 1, wherein the gear portion of the feed cylinder further comprises a plurality of detent edges such that a spring is engageable with one of the detent edges to limit rotational movement of the feed cylinder.

5. The method of firing the less-than-lethal pellet gun of claim 1, further comprising the steps of:

moving the bolt by the bias of the spring after the gun has fired to move a terminal portion of the linkage arm in the second slot region of the feed cylinder;

moving the terminal portion of the linkage arm in the second angled slot region after moving in the second slot region; and moving the terminal portion of the linkage arm in the first slot region after moving in the second angled slot region.

6. The method of firing the less-than-lethal pellet gun of claim 1, further comprising the steps of:

returning the trigger to its ready-to-fire position by the steps of:

providing a response trigger system which receives air from the container which moves a piston toward the trigger after the pellet is fired, wherein pulling the trigger biases against the piston pushing it to a cylinder, fluid then bleeds back through a flow control valve to the valve; and providing a fitting that is in fluid engagement with the valve, wherein a gap receives fluid when the bolt moves the stem, wherein the gap is also in fluid communication with the fitting which receives the fluid, wherein the fluid travels through the tube and into the flow control valve, wherein a fitting attaches to a flow control body and is in fluid communication therewith so fluid from the valve travels through a tube and fitting and into a cylinder, wherein fluid pressure accumulates in the cylinder pushing the piston against the trigger back to the ready-to-fire position.

7. The method of firing the less-than-lethal pellet gun of claim 6, wherein movement of the response trigger system is adjustable so the firing rate of the pellet gun can be changed.

8. The method of firing the less-than-lethal pellet gun of claim 1, further comprising the steps of:

returning the gun to the ready-to-fire condition by moving the bolt away from the stem of the valve which concurrently moves the linkage arm which rotates the feed to move another link.

9. The method of firing the less-than-lethal pellet gun of claim 1, wherein the feed cylinder rotates in about 22.5 degree increments.

10. The method of firing the less-than-lethal pellet gun of claim 1, wherein as the front and rear lobes continue to rotate as the feed cylinder continues to rotate, additional links are drawn into the pellet gun to be fired.

11. The method of firing the less-than-lethal pellet gun of claim 1, wherein a spring abuts against a detent edge on the feed cylinder to prevent the feed cylinder from freely rotating in a direction.

12. A less-than-lethal pellet gun comprising:

a plurality of links each holding a pellet and configured to be fired through a barrel of the pellet gun;

a feed cylinder configured to advance the links to a firing position and eject each link after its pellet has been fired;

a trigger configured to cause a bolt attached to a linkage arm to move linearly;

wherein the feed cylinder includes a slot portion and a gear portion;

wherein the slot portion includes a first slot region, a second slot region, a first angled slot region, and a second angled slot region;

wherein a portion of the linkage arm is configured to engage the slot portion of the feed cylinder such that linear movement of the linkage arm causes the portion of the linkage arm to travel along the first and second slot and first and second angled slot regions to rotate the feed cylinder;

wherein at least one of the plurality of links is configured to engage a portion of the gear portion of the feed cylinder;

wherein the feed cylinder is configured to move the one of the plurality of links holding the pellet to a firing position;

a sear configured to selectively release from a notch in the bolt;

wherein the bolt is configured to bias against a spring to move the bolt until it engages a stern which is configured to release fluid from a container into a valve and toward the link to fire the pellet;

wherein the gun is configured to supply fluid back through a portion of the valve to move the bolt against the bias of the spring to reset the gun to a ready-to-fire position;

wherein the linkage arm is configured to move through the second angled slot and first slot portions after the pellet is fired to eject the one link the pellet was fired from and replace with a second link; and wherein both trigger and notch in the bolt is configured to be engaged by the sear after the pellet has fired to hold the bolt away from the stem which closes the valve to prepare the gun to fire again.

13. The less-than-lethal pellet gun of claim 12, wherein the first and second slot regions are offset from each other, wherein the feed cylinder is configured not to rotate as the linkage arm travels in slot regions, wherein the portion of the linkage arm that is engageable with the first angled portion is configured to rotate the feed cylinder in one direction, and the portion of the linkage arm is movable in another direction and engage the second angled portion.

14. The less-than-lethal pellet gun of claim 12, wherein the gear portion further comprises front lobes separated by front channels and rear lobes separated by rear channels, wherein one of the plurality of links sits in the front and rear channels such that as the feed cylinder rotates, so too does the plurality of links.

15. The less-than-lethal pellet gun of claim 12, wherein the gear portion of the feed cylinder further comprises a plurality of detent edges such that a spring is engageable with one of the detent edges to limit rotational movement of the feed cylinder.

16. The less-than-lethal pellet gun of claim 12, wherein the bolt is configured to move by the bias of the spring after the gun has fired to move a terminal portion of the linkage arm in the second slot region of the feed cylinder; and configured to move the terminal portion of the linkage arm in second angled slot region after moving in the second slot region; and configured to move the terminal portion of the linkage arm in the first slot region after moving in the second angled slot region.

17. The less-than-lethal pellet gun of claim 1, wherein the trigger is configured to return to its ready-to-fire position by a response trigger system configured to receive fluid from the container which moves a piston toward the trigger after the pellet is fired; wherein pulling the trigger biases against the piston pushing it to a cylinder; fluid then bleeds back through a flow control valve to the valve; and a fitting that is in fluid engagement with the valve, wherein a gap receives fluid when the bolt moves the stern, wherein the gap is also in fluid communication with the fitting which receives the fluid, wherein the fluid travels through the tube and into the flow control valve, wherein a fitting attaches to a flow control body and is in fluid communication therewith so fluid from the valve travels through a tube, a fitting, and into a cylinder, wherein fluid pressure accumulates in the cylinder pushing the piston against the trigger back to the ready-to-fire position.

18. The less-than-lethal pellet gun of claim 17, wherein movement of the response trigger system is adjustable so the firing rate of the pellet gun can be changed.

19. The less-than-lethal pellet gun of claim 12, wherein the gun is configured to return to the ready-to-fire condition by moving the bolt away from the stem of the valve which concurrently moves the linkage arm which rotates the feed to move another link.

20. The less-than-lethal pellet gun of claim 12, wherein the feed cylinder is configured to rotate in about 22.5 degree increments.

21. The less-than-lethal pellet gun of claim 12, wherein the front and rear lobes are configured to continue to rotate as the feed cylinder rotates to draw additional links into the pellet gun to be fired.

22. The less-than-lethal pellet gun of claim 12, wherein a spring is configured to abut against a detent edge on the feed cylinder to prevent the feed cylinder from freely rotating.

* * * * *